US012663188B2

(12) United States Patent
Nakanishi et al.

(10) Patent No.: US 12,663,188 B2
(45) Date of Patent: Jun. 23, 2026

(54) HEAT SOURCE UNIT AND AIR CONDITIONER

(71) Applicant: DAIKIN INDUSTRIES, LTD., Osaka (JP)

(72) Inventors: Takaya Nakanishi, Osaka (JP); Yuta Fukuyama, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 178 days.

(21) Appl. No.: 18/427,989

(22) Filed: Jan. 31, 2024

(65) Prior Publication Data

US 2024/0167735 A1 May 23, 2024

Related U.S. Application Data

(63) Continuation of application No. PCT/JP2022/034761, filed on Sep. 16, 2022.

(30) Foreign Application Priority Data

Oct. 7, 2021 (JP) ..... 2021-165740

(51) Int. Cl.
*F25B 13/00* (2006.01)
*F25B 41/26* (2021.01)
*F25B 47/02* (2006.01)

(52) U.S. Cl.
CPC ..... *F25B 13/00* (2013.01); *F25B 41/26* (2021.01); *F25B 47/02* (2013.01)

(58) Field of Classification Search
CPC ..... F25B 13/00; F25B 2313/005; F25B 2313/007; F25B 2313/0231;
(Continued)

(56) References Cited

U.S. PATENT DOCUMENTS

2012/0285186 A1* 11/2012 Honda ..... F25B 7/00 62/157
2012/0285188 A1* 11/2012 Honda ..... F25B 7/00 62/238.1
(Continued)

FOREIGN PATENT DOCUMENTS

EP 3 385 646 A1 10/2018
EP 3 647 672 A1 5/2020
(Continued)

OTHER PUBLICATIONS

International Preliminary Report on Patentability and English translation of the Written Opinion of the International Searching Authority for International Application No. PCT/JP2022/034761, dated Apr. 18, 2024.
(Continued)

*Primary Examiner* — Henry T Crenshaw
(74) *Attorney, Agent, or Firm* — Birch, Stewart, Kolasch & Birch, LLP

(57) ABSTRACT

A heat source unit includes a first switching valve configured to switch between a first state where the first switching valve brings a high and low pressure gas connection pipe and a discharge side of a compressor into communication with each other and a second state where the first switching valve brings the high and low pressure gas connection pipe and a suction side of the compressor into communication with each other; and a second switching valve configured to switch between a third state where while the second switching valve brings the discharge side of the compressor and a gas end of a first heat exchange section into communication with each other, the second switching valve brings the suction side of the compressor and a gas end of the second heat exchange section into communication with each other and a fourth state where while the second switching valve brings the discharge side of the compressor and the gas end
(Continued)

of the second heat exchange section into communication with each other, the second switching valve brings the suction side of the compressor and the gas end of the first heat exchange section into communication with each other.

15 Claims, 11 Drawing Sheets

(58) Field of Classification Search
CPC ..... F25B 2313/0254; F25B 2313/0272; F25B 2313/02742; F25B 2400/16; F25B 2500/18; F25B 39/02; F25B 39/04; F25B 41/26; F25B 47/02; F25B 47/025
See application file for complete search history.

(56) References Cited

U.S. PATENT DOCUMENTS

| | | | | |
|---|---|---|---|---|
| 2017/0130997 | A1* | 5/2017 | Honda | F25B 13/00 |
| 2017/0198955 | A1 | 7/2017 | Minami et al. | |

FOREIGN PATENT DOCUMENTS

| | | | |
|---|---|---|---|
| EP | 4 328 510 | A1 | 2/2024 |
| JP | 2016-191502 | A | 11/2016 |

OTHER PUBLICATIONS

Extended European Search Report for European Application No. 22878309.8, dated Sep. 24. 2024.
International Search Report (PCT/ISA/210) issued in PCT/JP2022/034761, dated Nov. 1, 2022.

* cited by examiner

SIMULTANEOUS COOLING AND HEATING OPERATION (FIRST ACTION)

HEAT SOURCE UNIT AND AIR CONDITIONER

CROSS REFERENCE TO RELATED APPLICATIONS

This application is a Continuation of PCT International Application No. PCT/JP2022/034761, filed on Sep. 16, 2022, which claims priority under 35 U.S.C. 119(a) to Patent Application No. 2021-165740, filed in Japan on Oct. 7, 2021, all of which are hereby expressly incorporated by reference into the present application.

TECHNICAL FIELD

The present disclosure relates to a heat source unit and an air conditioner.

BACKGROUND ART

Patent Document 1 discloses an air conditioner that performs a cooling operation, a heating operation, and a simultaneous cooling and heating operation. As illustrated in FIG. 2 of Patent Document 1, a heat source unit of the air conditioner includes a first heat exchange section, a second heat exchange section, and three switching valves. A first switching valve switches between a state where a high and low pressure gas connection pipe and the suction side of a compressor communicate with each other and a state where the high and low pressure gas connection pipe and the discharge side of the compressor communicate with each other. A second switching valve switches between a state where the first heat exchange section functions as an evaporator and a state where the first heat exchange section functions as a radiator (condenser). A third switching valve switches between a state where the second heat exchange section functions as an evaporator and a state where the second heat exchange section functions as a radiator (condenser).

CITATION LIST

Patent Document

Patent Document 1: Japanese Unexamined Patent Publication No. 2016-191502

SUMMARY

A first aspect is directed to a heat source unit connected to a first flow path switching unit (50A) and a second flow path switching unit (50B) through a liquid connection pipe (2), a high and low pressure gas connection pipe (3), and a low pressure gas connection pipe (4) and provided in an air conditioner (1) configured to perform a cooling operation, a heating operation, and a simultaneous cooling and heating operation. The first flow path switching unit (50A) corresponds to a first utilization unit (40A). The second flow path switching unit (50B) corresponds to a second utilization unit (40B). The heat source unit includes: a compressor (11) configured to compress a refrigerant; a first heat exchange section (21) configured to exchange heat between the refrigerant and air; a second heat exchange section (22) configured to exchange heat between the refrigerant and the air; a liquid line (28) connected to a liquid end of the first heat exchange section (21) and a liquid end of the second heat exchange section (22); a first switching valve (35) configured to switch between a first state where the first switching valve (35) brings the high and low pressure gas connection pipe (3) and a discharge side of the compressor (11) into communication with each other and a second state where the first switching valve (35) brings the high and low pressure gas connection pipe (3) and a suction side of the compressor (11) into communication with each other; and a second switching valve (36) configured to switch between a third state where while the second switching valve (36) brings the discharge side of the compressor (11) and a gas end of the first heat exchange section (21) into communication with each other, the second switching valve (36) brings the suction side of the compressor (11) and a gas end of the second heat exchange section (22) into communication with each other and a fourth state where while the second switching valve (36) brings the discharge side of the compressor (11) and the gas end of the second heat exchange section (22) into communication with each other, the second switching valve (36) brings the suction side of the compressor (11) and the gas end of the first heat exchange section (21) into communication with each other.

DESCRIPTION OF EMBODIMENTS

Embodiments of the present disclosure will be described in detail below with reference to the drawings. The present disclosure is not limited to the embodiments shown below, and various changes can be made within the scope without departing from the technical concept of the present disclosure. Since each of the drawings is intended to illustrate the present disclosure conceptually, dimensions, ratios, or numbers may be exaggerated or simplified as necessary for the sake of ease of understanding.

(1) General Configuration of Air Conditioner

An air conditioner (1) of this embodiment is installed in a building or any other structure to adjust the temperature of air in a target space. The target space of this example is an indoor space (R). The air conditioner (1) cools and heats the indoor space (R).

Figure 1:
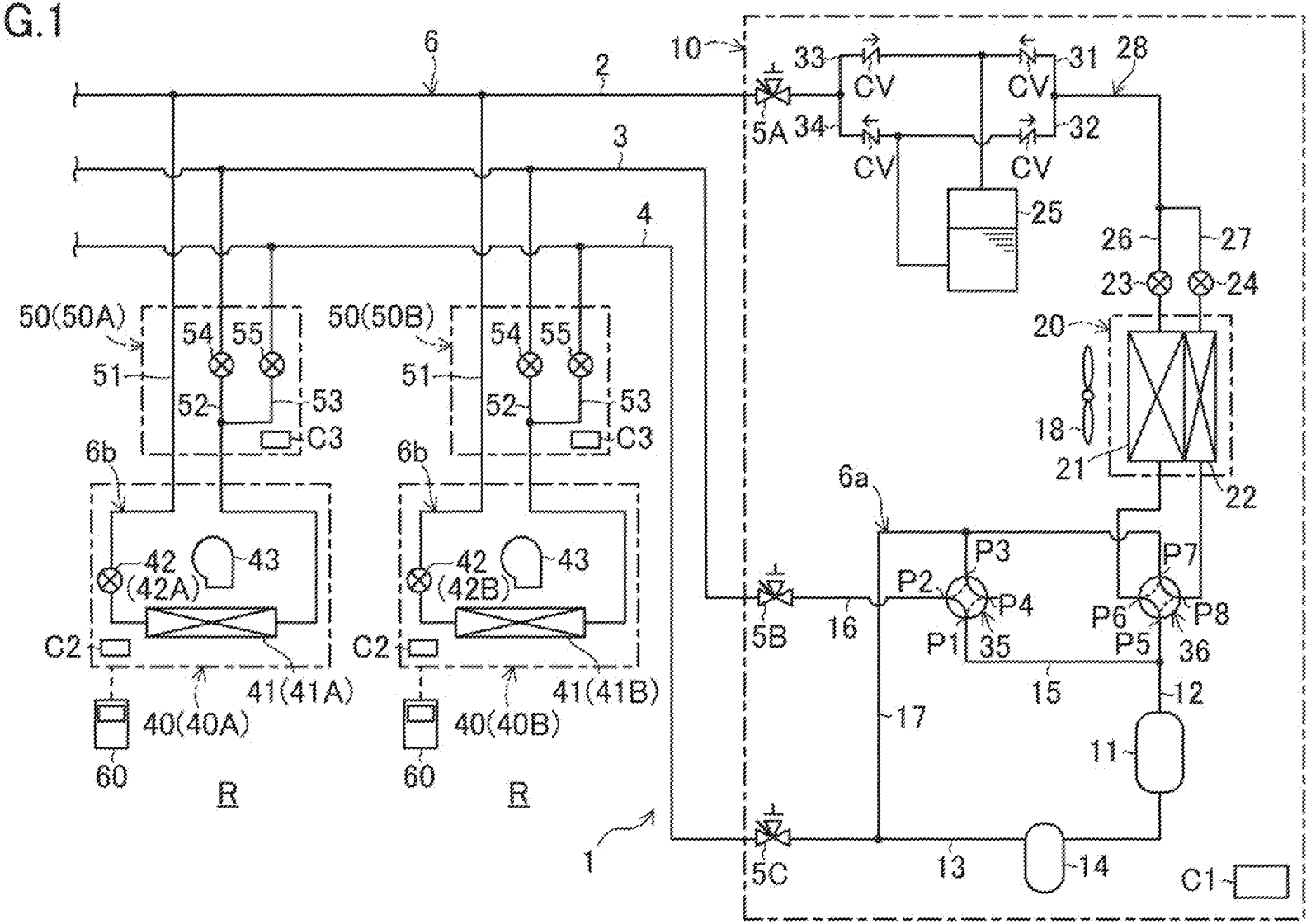
FIG. 1 is a piping system diagram of an air conditioner according to an embodiment.

As illustrated in FIG. 1, the air conditioner (1) includes one outdoor unit (10), a plurality of indoor units (40), a plurality of flow path switching units (50), three connection pipes (2, 3, 4), and a control unit (C).

The outdoor unit (10) is an example of a heat source unit, and is placed outdoors. The outdoor unit (10) includes a first stop valve (5A), a second stop valve (5B), and a third stop valve (5C).

Each indoor unit (40) is an example of a utilization unit, and is installed indoors. The number of the plurality of indoor units (40) merely needs to be two or more, and may be three, four, or five or more, for example. The air conditioner (1) of this example includes a first indoor unit (40A) serving as a first utilization unit and a second indoor unit (40B) serving as a second utilization unit. The first and second indoor units (40A) and (40B) have the same basic configuration. Each of the first and second indoor units (40A) and (40B) may be hereinafter referred to as the "indoor unit (40)."

The flow path switching units (50) are provided to correspond to the respective indoor units (40). The number of the flow path switching units (50) merely needs to be two or more, and may be three, four, or five or more, for example. The air conditioner (1) of this example includes a first flow path switching unit (50A) and a second flow path switching unit (50B). The first flow path switching unit (50A) corresponds to the first indoor unit (40A). The second flow path switching unit (50B) corresponds to the second indoor unit (40B). The first and second flow path switching units (50A) and (50B) have the same basic configuration. Each of the first and second flow path switching units (50A) and (50B) may be hereinafter referred to as the "flow path switching unit (50)."

The three connection pipes include a liquid connection pipe (2), a high and low pressure gas connection pipe (3), and a low pressure gas connection pipe (4). The first and second flow path switching units (50A) and (50B) are connected to the outdoor unit (10) through the three connection pipes (2, 3, 4). One end of the liquid connection pipe (2) is connected to the first stop valve (5A) of the outdoor unit (10). One end of the high and low pressure gas connection pipe (3) is connected to the second stop valve (5B) of the outdoor unit (10). One end of the low pressure gas connection pipe (4) is connected to the third stop valve (5C) of the outdoor unit (10). The other end of the liquid connection pipe (2) branches off so as to be connected to the plurality of flow path switching units (50). The other end of the high and low pressure gas connection pipe (3) branches off so as to be connected to the plurality of flow path switching units (50). The other end of the low pressure gas connection pipe (4) branches off so as to be connected to the plurality of flow path switching units (50).

The air conditioner (1) includes a refrigerant circuit (6) filled with a refrigerant. The refrigerant circulates in the refrigerant circuit (6) to perform a vapor compression refrigeration cycle. The refrigerant is, for example, R32 (difluoromethane), but may be another type of refrigerant. The refrigerant circuit (6) includes an outdoor circuit (6*a*) serving as a heat source circuit provided in the outdoor unit (10), and indoor circuits (6*b*) serving as utilization circuits provided in the respective indoor units (40).

(2) Components of Air Conditioner (2-1) Outdoor Unit

The outdoor unit (10) includes a compressor (11) and an outdoor heat exchanger (20).

The compressor (11) compresses a refrigerant, and discharges the compressed refrigerant. The compressor (11) is a scroll or rotary compressor. The outdoor unit (10) of this example includes the single compressor (11), but may include two or more compressors connected in series or in parallel. The compressor (11) is a hermetic compressor including a motor. Control performed by an inverter device allows the number of revolutions of the motor of the compressor (11) to be variable. In other words, the compressor (11) is configured to make the number of revolutions (operation frequency) thereof variable.

The outdoor circuit (6*a*) includes a discharge pipe (12) connected to the discharge side of the compressor (11), and a suction pipe (13) connected to the suction side of the compressor (11).

The suction pipe (13) is connected to the low pressure gas connection pipe (4) via the third stop valve (5C). The suction pipe (13) is provided with an accumulator (14). The accumulator (14) stores the refrigerant on the suction side of the compressor (11). The accumulator (14) stores a liquid refrigerant, and guides a gas refrigerant to the compressor (11).

The outdoor circuit (6*a*) includes a discharge branch pipe (15), a gas relay pipe (16), and a suction branch pipe (17). The discharge branch pipe (15) is connected to an intermediate portion of the discharge pipe (12). The gas relay pipe (16) is connected to the high and low pressure gas connection pipe via the second stop valve (5B). The suction branch pipe (17) is connected to an intermediate portion of the suction pipe (13).

The outdoor heat exchanger (20) is an example of a heat source heat exchanger. The outdoor heat exchanger (20) constitutes an air heat exchanger that exchanges heat between the refrigerant and air (strictly speaking, outdoor air). The outdoor heat exchanger (20) is a fin-and-tube heat exchanger. The outdoor heat exchanger (20) includes a first heat exchange section (21) and a second heat exchange section (22). In this example, the first and second heat exchange sections (21) and (22) are integrated together, and are provided in the outdoor heat exchanger (20).

The outdoor unit (10) includes an outdoor fan (18) as a heat source fan. The outdoor fan (18) transfers outdoor air. The outdoor air transferred by the outdoor fan (18) passes through the outdoor heat exchanger (20). The outdoor fan (18) is a propeller fan.

The outdoor unit (10) includes a first outdoor expansion valve (23), a second outdoor expansion valve (24), and a receiver (25).

The first outdoor expansion valve (23) is an example of a first heat source expansion valve. The first outdoor expansion valve (23) is provided in the outdoor circuit (6*a*) to correspond to the first heat exchange section (21). The first outdoor expansion valve (23) decompresses the refrigerant. The first outdoor expansion valve (23) adjusts the flow rate of the refrigerant. The first outdoor expansion valve (23) is configured as an electronic expansion valve having a variable opening degree.

The second outdoor expansion valve (24) is an example of a second heat source expansion valve. The second outdoor expansion valve (24) is provided in the outdoor circuit (6*a*) to correspond to the second heat exchange section (22). The second outdoor expansion valve (24) decompresses the refrigerant. The second outdoor expansion valve (24) adjusts the flow rate of the refrigerant. The second outdoor expansion valve (24) is configured as an electronic expansion valve having a variable opening degree.

The receiver (25) is a container that accumulates the refrigerant. Strictly speaking, the receiver (25) accumulates a surplus of the liquid refrigerant in the refrigerant circuit (6).

The outdoor circuit (6*a*) includes a first flow path (26), a second flow path (27), and a liquid line (28). The first flow path (26) is provided with the first heat exchange section (21) and the first outdoor expansion valve (23) in this order from the gas end toward the liquid end thereof. The second flow path (27) is provided with the second heat exchange section (22) and the second outdoor expansion valve (24) in this order from the gas end toward the liquid end thereof.

One end of the liquid line (28) is connected to the liquid end of the first flow path (26) and the liquid end of the second flow path (27). The liquid end of the first heat exchange section (21) is connected through the first flow path (26) to the liquid line (28). The liquid end of the second heat exchange section (22) is connected through the second flow path (27) to the liquid line (28). The other end of the liquid line (28) is connected to the first stop valve (5A). The liquid line (28) is provided with the receiver (25).

The liquid line (28) includes a first refrigerant pipe (31), a second refrigerant pipe (32), a third refrigerant pipe (33), and a fourth refrigerant pipe (34), which are connected in a bridge configuration. Each of these refrigerant pipes (31, 32, 33, 34) has a check valve (CV). Each of the check valves (CV) allows the refrigerant to pass therethrough in the direction of the corresponding arrow shown in FIG. 1 and prohibits the refrigerant to pass therethrough in the opposite direction. The inflow end of the first refrigerant pipe (31) and the outflow end of the second refrigerant pipe (32) communicate with the liquid ends of the first and second flow paths (26) and (27). The outflow end of the first refrigerant pipe (31) and the outflow end of the third refrigerant pipe (33) communicate with the inflow end of the receiver (25). The inflow end of the second refrigerant pipe (32) and the inflow end of the fourth refrigerant pipe (34) communicate with the outflow end of the receiver (25). The inflow end of the third refrigerant pipe (33) and the outflow end of the fourth refrigerant pipe (34) communicate with the liquid connection pipe (2) via the first stop valve (5A).

The outdoor unit (10) includes a first four-way switching valve (35) and a second four-way switching valve (36). The first four-way switching valve (35) is an example of a first switching valve. The second four-way switching valve (36) is an example of a second switching valve (36).

The first four-way switching valve (35) has a first port (P1), a second port (P2), a third port (P3), and a fourth port (P4). The first four-way switching valve (35) moves its spool using the difference between the discharge pressure and the suction pressure, thereby switching the state of communication between the ports (P1, P2, P3, P4). The first port (P1) is connected through the discharge branch pipe (15) to the discharge side of the compressor (11). The second port (P2) is connected through the gas relay pipe (16) and the second stop valve (5B) to the high and low pressure gas connection pipe (3). The third port (P3) is connected through the suction branch pipe (17) to the suction side of the compressor (11). The fourth port (P4) is closed by a blocking portion.

The first four-way switching valve (35) switches between a first state (the state indicated by the solid curves in FIG. 1) and a second state (the state indicated by the dotted curves in FIG. 1). The first four-way switching valve (35) in the first state makes the first port (P1) and the second port (P2) communicate with each other, and simultaneously makes the third port (P3) and the fourth port (P4) communicate with each other. In other words, the first four-way switching valve (35) in the first state makes the high and low pressure gas connection pipe (3) and the discharge side of the compressor (11) communicate with each other. In this state, the high and low pressure gas connection pipe (3) substantially functions as a high-pressure gas line. The first four-way switching valve (35) in the second state makes the first port (P1) and the fourth port (P4) communicate with each other, and simultaneously makes the second port (P2) and the third port (P3) communicate with each other. In other words, the first four-way switching valve (35) in the second state makes the high and low pressure gas connection pipe (3) and the suction side of the compressor (11) communicate with each other. In this state, the high and low pressure gas connection pipe (3) substantially functions as a low-pressure gas line.

The second four-way switching valve (36) has a fifth port (P5), a sixth port (P6), a seventh port (P7), and an eighth port (P8). The second four-way switching valve (36) moves its spool using the difference between the discharge pressure and the suction pressure, thereby switching the state of communication between the ports (P5, P6, P7, P8). The fifth port (P5) is connected through the discharge pipe (12) to the discharge side of the compressor (11). The sixth port (P6) is connected to the gas end of the first heat exchange section (21). The seventh port (P7) is connected through the suction branch pipe (17) to the suction side of the compressor (11). The eighth port (P8) is connected to the gas end of the second heat exchange section (22).

The second four-way switching valve (36) switches between a third state (the state indicated by the solid curves in FIG. 1) and a fourth state (the state indicated by the dotted curves in FIG. 1). The second four-way switching valve (36) in the third state makes the fifth port (P5) and the sixth port (P6) communicate with each other, and simultaneously makes the seventh port (P7) and the eighth port (P8) communicate with each other. In other words, the second four-way switching valve (36) in the third state makes the discharge side of the compressor (11) and the gas end of the first heat exchange section (21) communicate with each other, and simultaneously makes the suction side of the compressor (11) and the gas end of the second heat exchange section (22) communicate with each other. In this state, the first heat exchange section (21) functions as a radiator, and the second heat exchange section (22) functions as an evaporator. The second four-way switching valve (36) in the fourth state makes the fifth port (P5) and the eighth port (P8) communicate with each other, and simultaneously makes the sixth port (P6) and the seventh port (P7) communicate with each other. In other words, the second four-way switching valve (36) in the fourth state makes the discharge side of the compressor (11) and the gas end of the second heat exchange section (22) communicate with each other, and simultaneously makes the suction side of the compressor (11) and the gas end of the first heat exchange section (21) communicate with each other. In this state, the second heat exchange section (22) functions as a radiator, and the first heat exchange section (21) functions as an evaporator.

(2-2) Indoor Unit

The indoor units (40) are air conditioning indoor units that condition air in the indoor space (R). The indoor units (40) are of, for example, a ceiling-mounted type. The "ceiling-mounted type" as used herein includes the type in which an indoor unit (40) is installed behind the ceiling, the type in which an indoor unit (40) is embedded in the ceiling surface, and the type in which an indoor unit (40) is suspended from a slab or any other member. In the air conditioner (1), a cooling action or a heating action can be selected for each of the plurality of indoor units (40). The "cooling action" as used herein is an action performed by the indoor unit (40) to cool air in the target space. The "heating action" as used herein is an action performed by the indoor unit (40) to heat air in the target space.

Each indoor unit (40) includes an indoor heat exchanger (41) and an indoor expansion valve (42). Each indoor circuit (6*b*) is provided with the indoor expansion valve (42) and the indoor heat exchanger (41) in this order from the liquid end toward the gas end thereof.

The indoor heat exchanger (41) is an example of a utilization heat exchanger. The indoor heat exchanger (41) constitutes an air heat exchanger that exchanges heat between the refrigerant and air (strictly speaking, indoor air). The indoor heat exchanger (41) is a fin-and-tube heat exchanger.

The indoor expansion valve (42) is an example of a utilization expansion valve. The indoor expansion valve (42) decompresses the refrigerant. The indoor expansion valve (42) is configured as an electronic expansion valve having a variable opening degree.

Each indoor unit (40) includes an indoor fan (43) as a utilization fan. The indoor fan (43) is, for example, a sirocco fan or a turbo fan. The indoor fan (43) transfers indoor air. The indoor fan (43) draws indoor air in the indoor space (R) into a casing (not shown). The air passes through the indoor heat exchanger (41), and is then blown out of the casing into the indoor space.

The indoor heat exchanger (41) of the first indoor unit (40A) may be hereinafter referred to as the "first indoor heat exchanger (41A)," the indoor heat exchanger (41) of the second indoor unit (40B) as the "second indoor heat exchanger (41B)," the indoor expansion valve (42) of the first indoor unit (40A) as the "first indoor expansion valve (42A)," and the indoor expansion valve (42) of the second indoor unit (40B) as the "second indoor expansion valve (42B)."

(2-3) Flow Path Switching Unit

The flow path switching units (50) are provided to enable the simultaneous cooling and heating operation of the air conditioner (1). The flow path switching units (50) are provided behind the ceiling of the room, for example. Each flow path switching unit (50) switches between a state where while the liquid connection pipe (2) and the liquid end of the indoor circuit (6*b*) are brought into communication with each other, the high and low pressure gas connection pipe (3) and the gas end of the indoor circuit (6*b*) are brought into communication with each other and a state where while the liquid connection pipe (2) and the liquid end of the indoor circuit (6*b*) are brought into communication with each other, the low pressure gas connection pipe (4) and the gas end of the indoor circuit (6*b*) are brought into communication with each other.

The flow path switching units (50) each include a first relay pipe (51), a second relay pipe (S2), and a third relay pipe (53). One end of the first relay pipe (51) is connected to the liquid connection pipe (2). The other end of the first relay pipe (51) is connected to the liquid end of the indoor circuit (6*b*) of the associated indoor unit (40). One end of the second relay pipe (52) is connected to the high and low pressure gas connection pipe (3). The other end of the second relay pipe (52) is connected to the gas end of the indoor circuit (6*b*) of the associated indoor unit (40). One end of the third relay pipe (53) is connected to the low pressure gas connection pipe (4). The other end of the third relay pipe (53) is connected to an intermediate portion of the second relay pipe (52).

The second relay pipe (52) is provided with a first relay valve (54), and the third relay pipe (53) is provided with a second relay valve (55). The first relay valve (54) is provided between the junctions of the second relay pipe (52) with the high and low pressure gas connection pipe (3) and the third relay pipe (53). For example, the first relay valve (54) is a flow rate control valve having a variable opening degree. The first relay valve (54) may be an on-off valve. For example, the second relay valve (55) is a flow rate control valve having a variable opening degree. The second relay valve (55) may be an on-off valve.

(2-4) Control Unit

Figure 2:
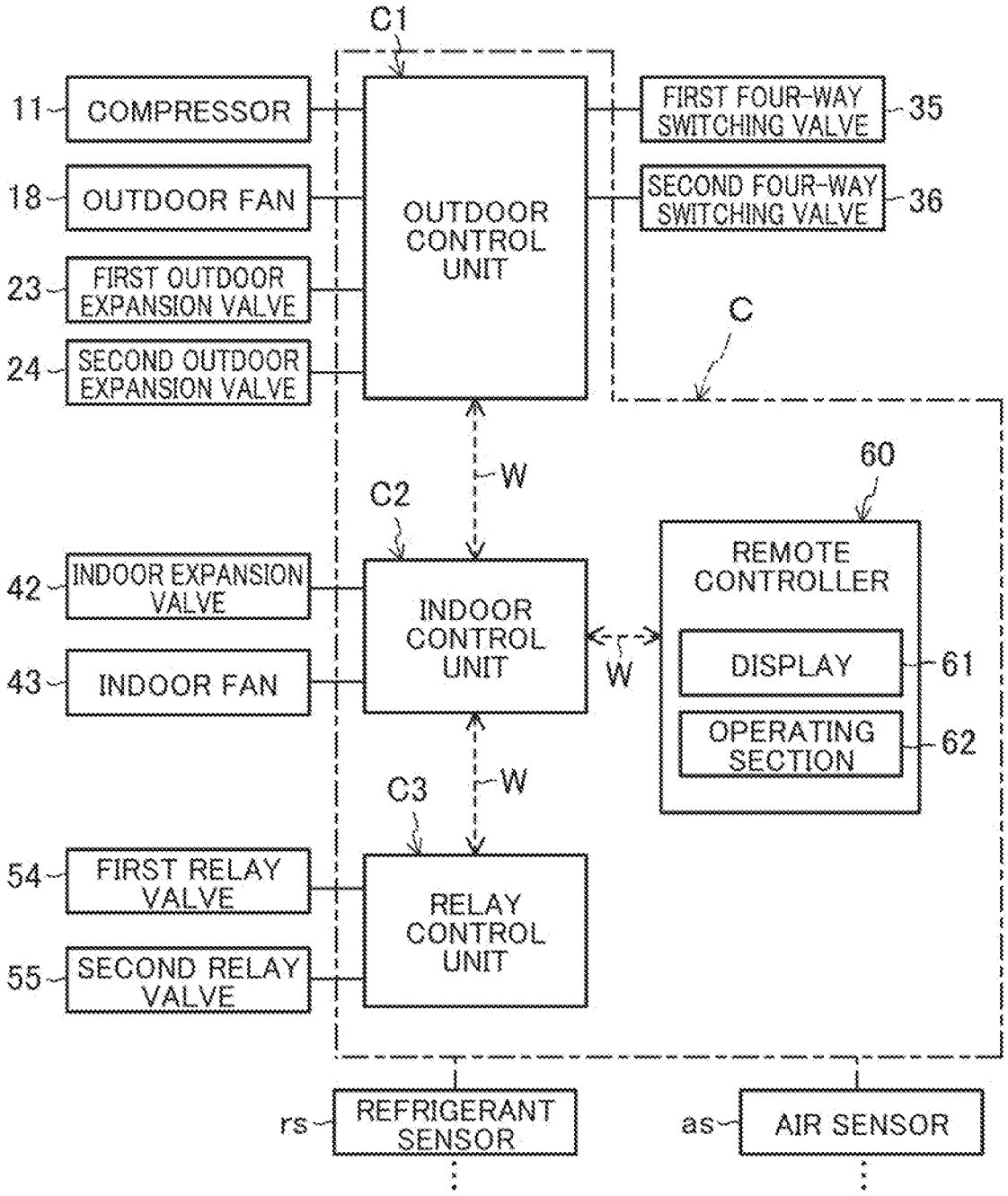
FIG. 2 is a block diagram of a control unit and its peripheral devices.

The control unit (C) controls operation of the air conditioner (1) and actions of various components. As shown in FIG. 2, the control unit (C) includes an outdoor control unit (C1) serving as a heat source control unit, a plurality of indoor control units (C2) serving as utilization control units, a plurality of relay control units (C3), and remote controllers (60). Each of the outdoor control unit (C1), the indoor control units (C2), the relay control units (C3), and the remote controller (60) includes a micro controller unit (MCU), an electric circuit, and an electronic circuit. The MCU includes a central processing unit (CPU), a memory, and a communication interface. The memory stores various programs to be executed by the CPU. The outdoor control unit (C1), the indoor control units (C2), the relay control units (C3), and the remote controllers (60) are connected together through wireless or wired communication lines. The relay control units (C3) in the example shown in FIG. 2 are each connected to the associated indoor control unit (C2), but may be connected to the outdoor control unit (C1).

The outdoor control unit (C1) is provided in the outdoor unit (10). The outdoor control unit (C1) controls components of the outdoor unit (10). Specifically, the outdoor control unit (C1) controls the compressor (11), the outdoor fan (18), the first outdoor expansion valve (23), the second outdoor expansion valve (24), the first four-way switching valve (35), and the second four-way switching valve (36).

The indoor control unit (C2) is provided in each of the first and second indoor units (40A) and (40B). The indoor control unit (C2) controls the components of the indoor unit (40). Specifically, the indoor control unit (C2) controls actions of the indoor expansion valve (42) and the indoor fan (43).

The relay control unit (C3) is provided in each of the first and second flow path switching units (50A) and (50B). The relay control unit (C3) controls the first and second relay valves (54) and (55).

The remote controllers (60) are provided for the respective indoor units (40). Each remote controller (60) is located at a position in the indoor space (R) where a user can operate it. The remote controller (60) has a display (61) and an operating section (62). The display (61) is, for example, a liquid crystal monitor, and displays predetermined information. The predetermined information includes information relating to the operating state of the air conditioner (1), information for switching operation of the air conditioner (1), and information relating to set values, such as a set temperature. The operating section (62) accepts input operations for various settings from the user. The operating section (62) is configured, for example, as a plurality of physical switches. The operating mode and set temperature of the air conditioner (1) can be changed by the user operating the operating section (62) of the remote controller (60).

(2-5) Sensor

As shown in FIG. 2, the air conditioner (1) has a plurality of refrigerant sensors (rs) and a plurality of air sensors (as).

Examples of the plurality of refrigerant sensors (rs) include a high-pressure sensor, a low-pressure sensor, a first refrigerant temperature sensor, a second refrigerant temperature sensor, an indoor refrigerant temperature sensor, a discharged refrigerant temperature sensor, and a suction refrigerant temperature sensor. The high-pressure sensor detects the high pressure of the refrigerant circuit (6). The low-pressure sensor detects the low pressure of the refrigerant circuit (6). The first refrigerant temperature sensor detects the temperature of the refrigerant in the first heat exchange section (21). The second refrigerant temperature sensor detects the temperature of the refrigerant in the second heat exchange section (22). The indoor refrigerant temperature sensor detects the temperature of the refrigerant in the indoor heat exchanger (41). The discharged refrigerant temperature sensor detects the temperature of the refrigerant discharged from the compressor (11). The suction refrigerant temperature sensor detects the temperature of the refrigerant sucked into the compressor (11).

The plurality of air sensors (as) include an outdoor air temperature sensor that detects the temperature of outdoor air and an indoor air temperature sensor that detects the temperature of indoor air. Strictly speaking, the indoor air temperature sensor is a suction temperature sensor that detects the temperature of the suction air sucked into the casing of the indoor unit.

(3) Details of Outdoor Unit

The outdoor unit (10), mainly the outdoor heat exchanger (20) and the outdoor fan (18), will be described in detail with reference to FIGS. 3 and 4.

The outdoor unit (10) includes an outdoor casing (10*a*). The outdoor casing (10*a*) is installed on top of a building, for example. The outdoor casing (10*a*) is formed in the shape of a vertically long box. The outdoor casing (10*a*) houses therein the outdoor heat exchanger (20) and the outdoor fan (18).

The outdoor heat exchanger (20) is installed on the bottom of the outdoor casing (10*a*). Side surfaces of the outdoor casing (10*a*) each have an opening (0) through which the first and second heat exchange sections (21) and (22) of the outdoor heat exchanger (20) are exposed. The outdoor heat exchanger (20) is a three-side heat exchanger with three side surfaces or a four-side heat exchanger with four side surfaces, for example.

Figure 4:
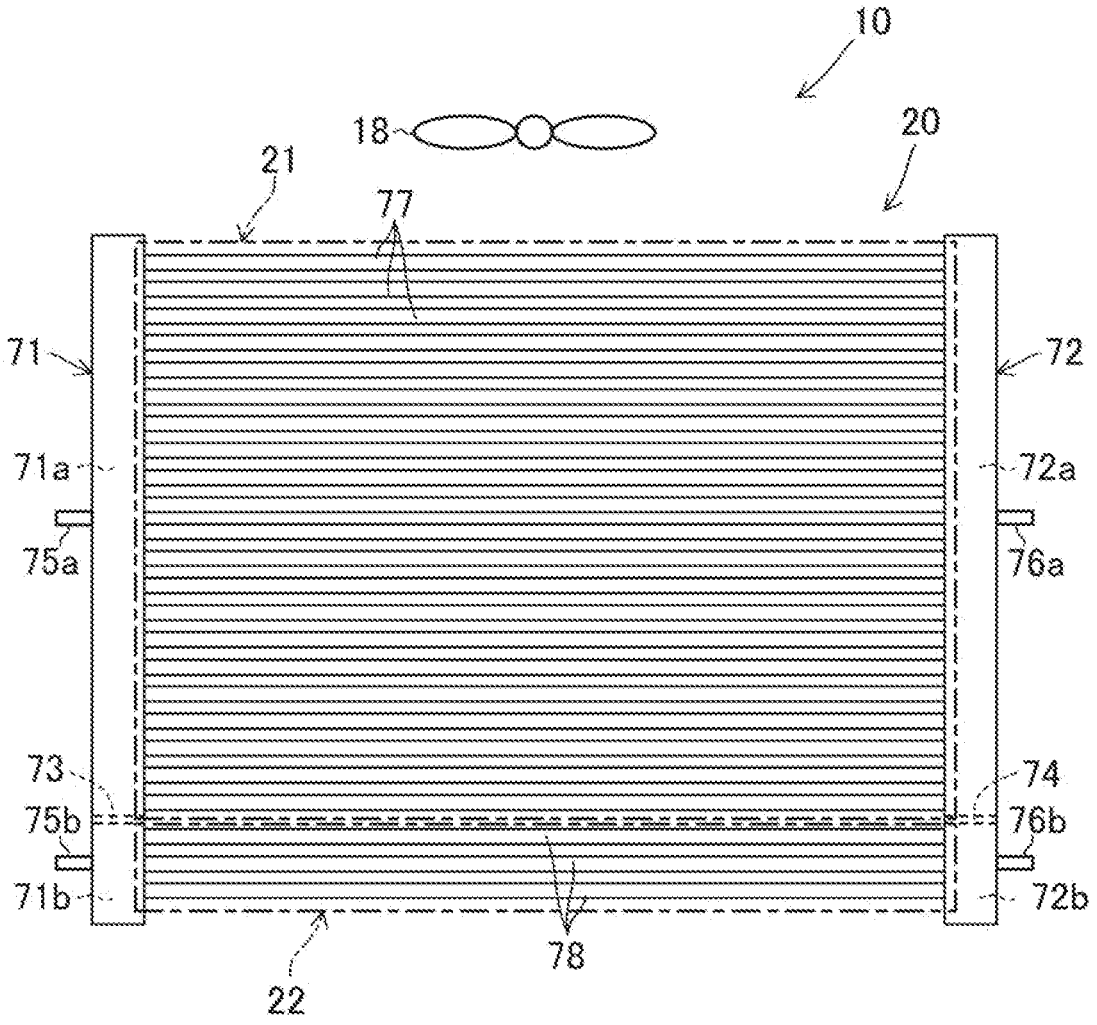
FIG. 4 schematically illustrates a configuration for an outdoor heat exchanger.

As illustrated in FIG. 4, the outdoor heat exchanger (20) includes a first header collecting pipe (71) and a second header collecting pipe (72). In FIG. 4, a plurality of side surfaces of the outdoor heat exchanger (20) are schematically shown in the form of one side surface for convenience. Each of the first and second header collecting pipes (71) and (72) is formed in a vertically long cylindrical shape with upper and lower ends closed. The first header collecting pipe (71) and the second header collecting pipe have the same height.

A first partition plate (73) is provided inside the first header collecting pipe (71). The first partition plate (73) is arranged in a lower portion of the first header collecting pipe (71). The first partition plate (73) partitions the internal space of the first header collecting pipe (71) into a first upper flow path (71*a*) and a first lower flow path (71*b*). The first upper flow path (71*a*) is located above the first partition plate (73), and the first lower flow path (71*b*) is located below the first partition plate (73). The first header collecting pipe (71) is connected to a first upper pipe (75*a*) communicating with the first upper flow path (71*a*) and a first lower pipe (75*b*) communicating with the first lower flow path (71*b*).

A second partition plate (74) is provided inside the second header collecting pipe (72). The second partition plate (74) is arranged in a lower portion of the second header collecting pipe (72). The second partition plate (74) is at the same height as the first partition plate (73). The second partition plate (74) partitions the internal space of the second header collecting pipe (72) into a second upper flow path (72*a*) and a second lower flow path (72*b*). The second upper flow path (72*a*) is located above the second partition plate (74), and the second lower flow path (72*b*) is located below the second partition plate (74). The second header collecting pipe (72) is connected to a second upper pipe (76*a*) communicating with the second upper flow path (72*a*) and a second lower pipe (76*b*) communicating with the second lower flow path (72*b*).

The first and second heat exchange sections (21) and (22) are provided between the first and second header collecting pipes (71) and (72). Specifically, the first heat exchange section (21) of the outdoor heat exchanger (20) is formed between the first and second upper flow paths (71*a*) and (72*a*). The first heat exchange section (21) includes a plurality of first heat transfer tubes (77) arranged vertically. The plurality of first heat transfer tubes (77) extend in the horizontal direction while being parallel to one another. One end of each first heat transfer tube (77) is connected to the first header collecting pipe (71). The one end of the first heat transfer tube (77) communicates with the first upper flow path (71*a*). The other end of the first heat transfer tube (77) is connected to the second header collecting pipe (72). The other end of the first heat transfer tube (77) communicates with the second upper flow path (72*a*).

The second heat exchange section (22) of the outdoor heat exchanger (20) is formed between the first and second lower flow paths (71*b*) and (72*b*). The second heat exchange section (22) includes a plurality of second heat transfer tubes (78) arranged vertically. The plurality of second heat transfer tubes (78) extend in the horizontal direction while being parallel to one another. One end of each second heat transfer tube (78) is connected to the first header collecting pipe (71). The one end of the second heat transfer tube (78) communicates with the first lower flow path (71*b*). The other end of the second heat transfer tube (78) is connected to the second header collecting pipe (72). The other end of the second heat transfer tube (78) communicates with the second lower flow path (72*b*).

Figure 3:
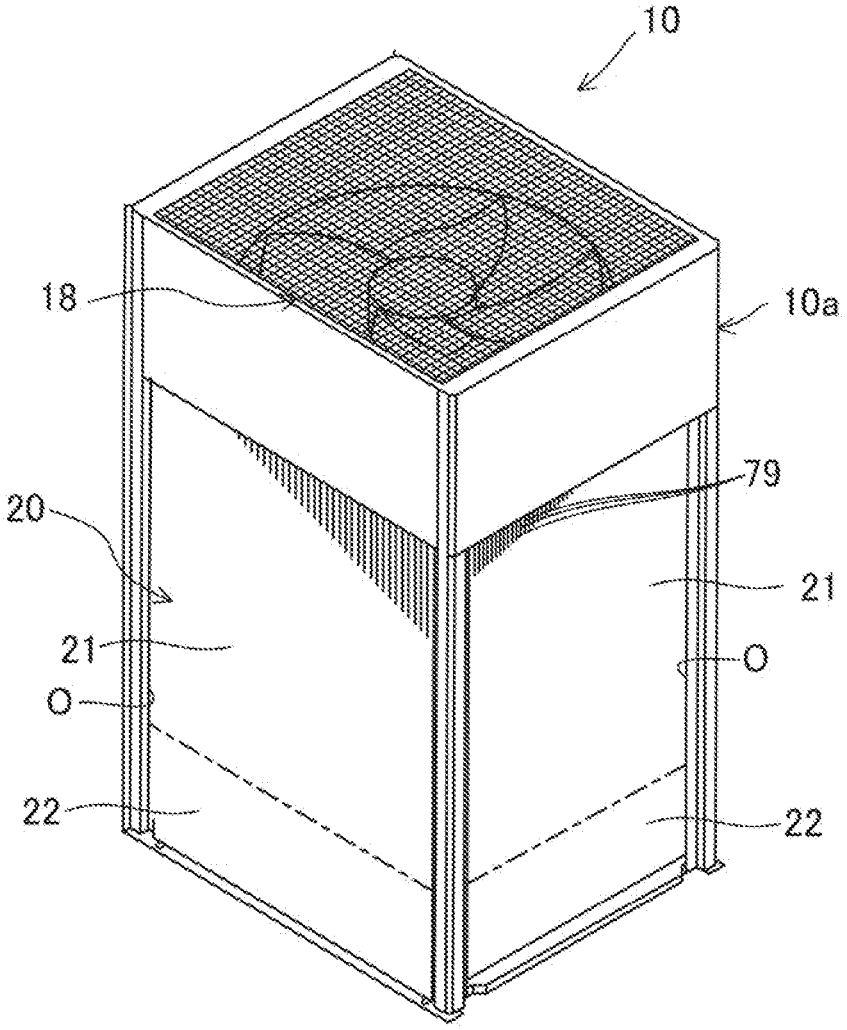
FIG. 3 is a schematic perspective view of an outdoor unit.

As schematically illustrated in FIG. 3, the outdoor heat exchanger (20) includes a plurality of fins (79). Each fin (79) is formed in a vertically long rectangular plate shape. The fins (79) are arranged in a direction along the first and second heat transfer tubes (77) and (78). The fins (79) of this example extend from the upper end to the lower end of the outdoor heat exchanger (20). The fins (79) are used for both the first and second heat exchange sections (21) and (22). In other words, the fins (79) are in contact with both the plurality of first heat transfer tubes (77) and the plurality of second heat transfer tubes (78).

The outdoor fan (18) is arranged above the outdoor heat exchanger (20). In the outdoor unit (10) of this example, the second heat exchange section (22) is located below the first heat exchange section (21), and the outdoor fan (18) is located above the first heat exchange section (21).

The first heat exchange section (21) has a greater size than the second heat exchange section (22) does. Strictly speaking, the size of the outer shape of the first heat exchange section (21) as a whole is greater than that of the outer shape of the second heat exchange section (22) as a whole. The ratio S2/S1 of the size S2 of the second heat exchange section (22) to the size S1 of the first heat exchange section (21) is preferably higher than or equal to 1/10 and equal to or lower than 1/5.

The total heat transfer area of the first heat exchange section (21) is larger than that of the second heat exchange section (22). The number of the first heat transfer tubes (77) of the first heat exchange section (21) is greater than the number of the second heat transfer tubes (78) of the second heat exchange section (22). In this example, the first heat transfer tubes (77) and the second heat transfer tubes (78) have the same diameter and the same length. The area of a region of the first heat exchange section (21) through which air can pass is larger than that of a region of the second heat exchange section (22) through which air can pass.

(4) Operation of Air Conditioner

The air conditioner (1) performs a cooling operation, a heating operation, a simultaneous cooling and heating operation, and a defrosting operation. The cooling operation is an operation in which one or all of the indoor units (40) in the operating state perform a cooling action. The heating operation is an operation in which one or all of the indoor units (40) in the operating state perform a heating action. The simultaneous cooling and heating operation is an operation in which one or more of the indoor units (40) in the operating state perform a cooling action and the other indoor unit or units (40) perform a heating action. The defrosting operation is an operation for defrosting the surface of the first heat exchange section (21) in winter or similar conditions. Operations of the first and second indoor units (40A) and (40B), which are the indoor units (40) in the operating state, will be described below. In the drawings showing the operations, the heat exchanger functioning as a radiator is hatched, and the heat exchanger functioning as an evaporator is dotted.

(4-1) Cooling Operation

Figure 5:
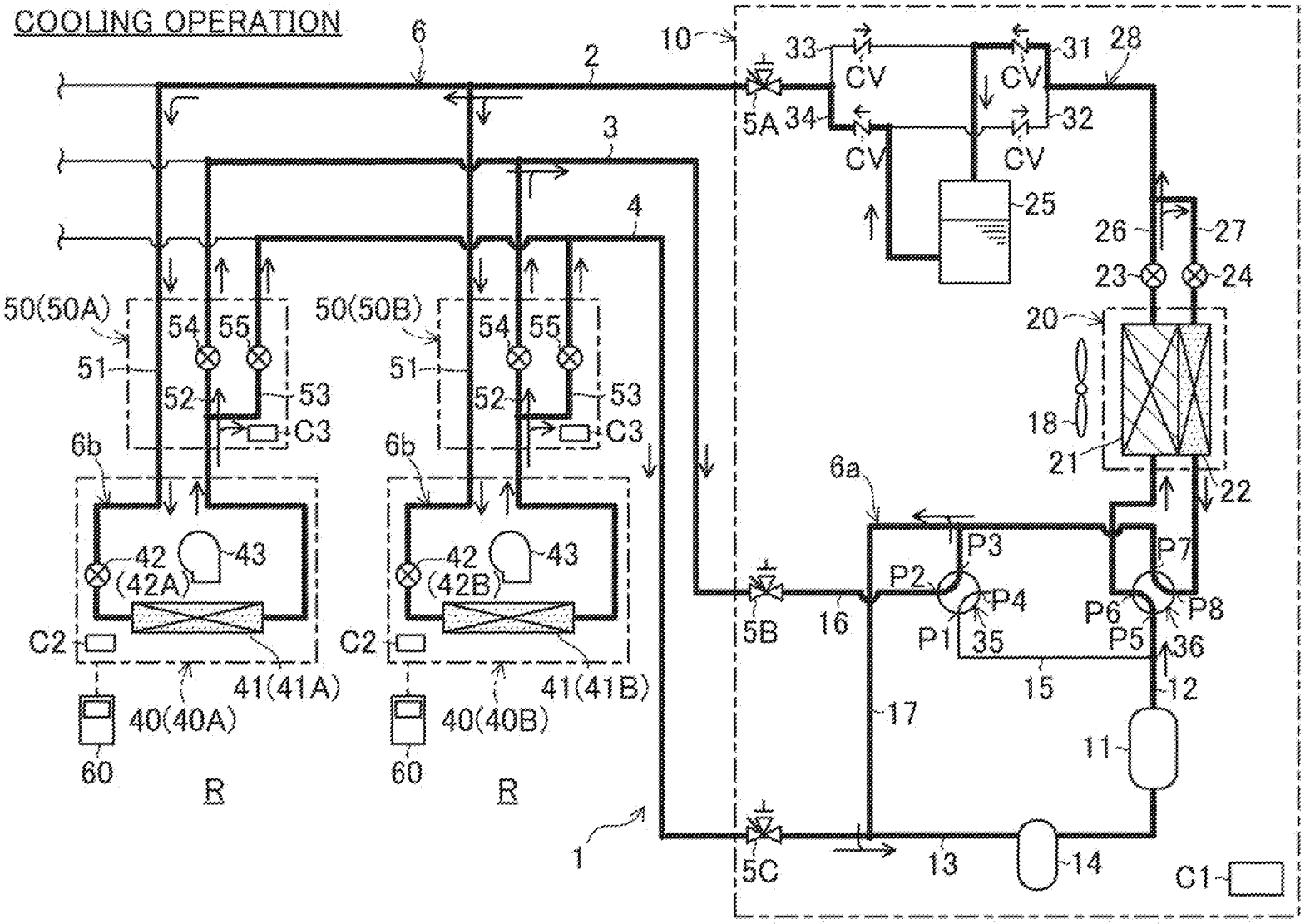
FIG. 5 is a piping system diagram of the air conditioner, and illustrates a flow of a refrigerant during a cooling operation.

The air conditioner (1) during the cooling operation illustrated in FIG. 5 performs a refrigeration cycle in which the first heat exchange section (21) functions as a radiator, and the second heat exchange section (22), the first indoor heat exchanger (41A), and the second indoor heat exchanger (41B) function as evaporators.

In the cooling operation, the control unit (C) places the first four-way switching valve (35) in the second state, places the second four-way switching valve (36) in the third state, and adjusts the opening degrees of the second outdoor expansion valve (24), the first indoor expansion valve (42A), and the second indoor expansion valve (42B) so that the refrigerant is decompressed by these valves. The control unit (C) opens the first outdoor expansion valve (23), the first relay valves (54), and the second relay valves (55). The control unit (C) operates the compressor (11), the outdoor fan (18), and the indoor fans (43).

The refrigerant compressed by the compressor (11) passes through the second four-way switching valve (36), and flows into the first flow path (26). The refrigerant in the first flow path (26) flows through the first heat exchange section (21). In the first heat exchange section (21), the refrigerant dissipates heat to outdoor air to condense. Part of the refrigerant that has dissipated heat in the first heat exchange section (21) flows into the liquid line (28), and the remaining portion of this refrigerant flows into the second flow path (27).

The refrigerant in the liquid line (28) flows through the receiver (25) and the liquid connection pipe (2), and is then diverted into the first and second flow path switching units (50A) and (50B).

The refrigerant that has flowed through the first relay pipe (51) of the first flow path switching unit (50A) is decompressed by the first indoor expansion valve (42A) of the first indoor unit (40A), and then flows through the first indoor heat exchanger (41A). In the first indoor heat exchanger (41A), the refrigerant absorbs heat from indoor air to evaporate. The air cooled by the first indoor heat exchanger (41A) is supplied into the indoor space (R). Part of the refrigerant that has evaporated in the first indoor heat exchanger (41A) passes through the second relay pipe (52) of the first flow path switching unit (50A), and then flows into the high and low pressure gas connection pipe (3). The remaining portion of the refrigerant that has evaporated in the first indoor heat exchanger (41A) passes through the third relay pipe (53) of the first flow path switching unit (50A), and then flows into the low pressure gas connection pipe (4).

The refrigerant that has flowed through the first relay pipe (51) of the second flow path switching unit (50B) is decompressed by the second indoor expansion valve (42B) of the second indoor unit (40B), and then flows through the second indoor heat exchanger (41B). In the second indoor heat exchanger (41B), the refrigerant absorbs heat from indoor air to evaporate. The air cooled by the second indoor heat exchanger (41B) is supplied into the indoor space (R). Part of the refrigerant that has evaporated in the second indoor heat exchanger (41B) passes through the second relay pipe (52) of the second flow path switching unit (50B), and then flows into the high and low pressure gas connection pipe (3). The refrigerant in the high and low pressure gas connection pipe (3) passes through the gas relay pipe (16) and the first four-way switching valve (35) in this order. The remaining portion of the refrigerant that has evaporated in the second indoor heat exchanger (41B) passes through the third relay pipe (53) of the second flow path switching unit (50B), and then flows into the low pressure gas connection pipe (4).

The refrigerant that has flowed into the second flow path (27) as described above is decompressed by the second outdoor expansion valve (24), and then flows through the second heat exchange section (22). In the second heat exchange section (22), the refrigerant absorbs heat from outdoor air to evaporate. The refrigerant that has evaporated in the second heat exchange section (22) passes through the second four-way switching valve (36).

The refrigerant that has passed through the first four-way switching valve (35) and the refrigerant that has passed through the second four-way switching valve (36) flow through the suction branch pipe (17). The refrigerant in the low pressure gas connection pipe (4) and the refrigerant in the suction branch pipe (17) flow through the suction pipe (13). The refrigerant in the suction pipe (13) passes through the accumulator (14), and is then sucked into the compressor (11) so as to be compressed again.

(4-2) Heating Operation

Figure 6:
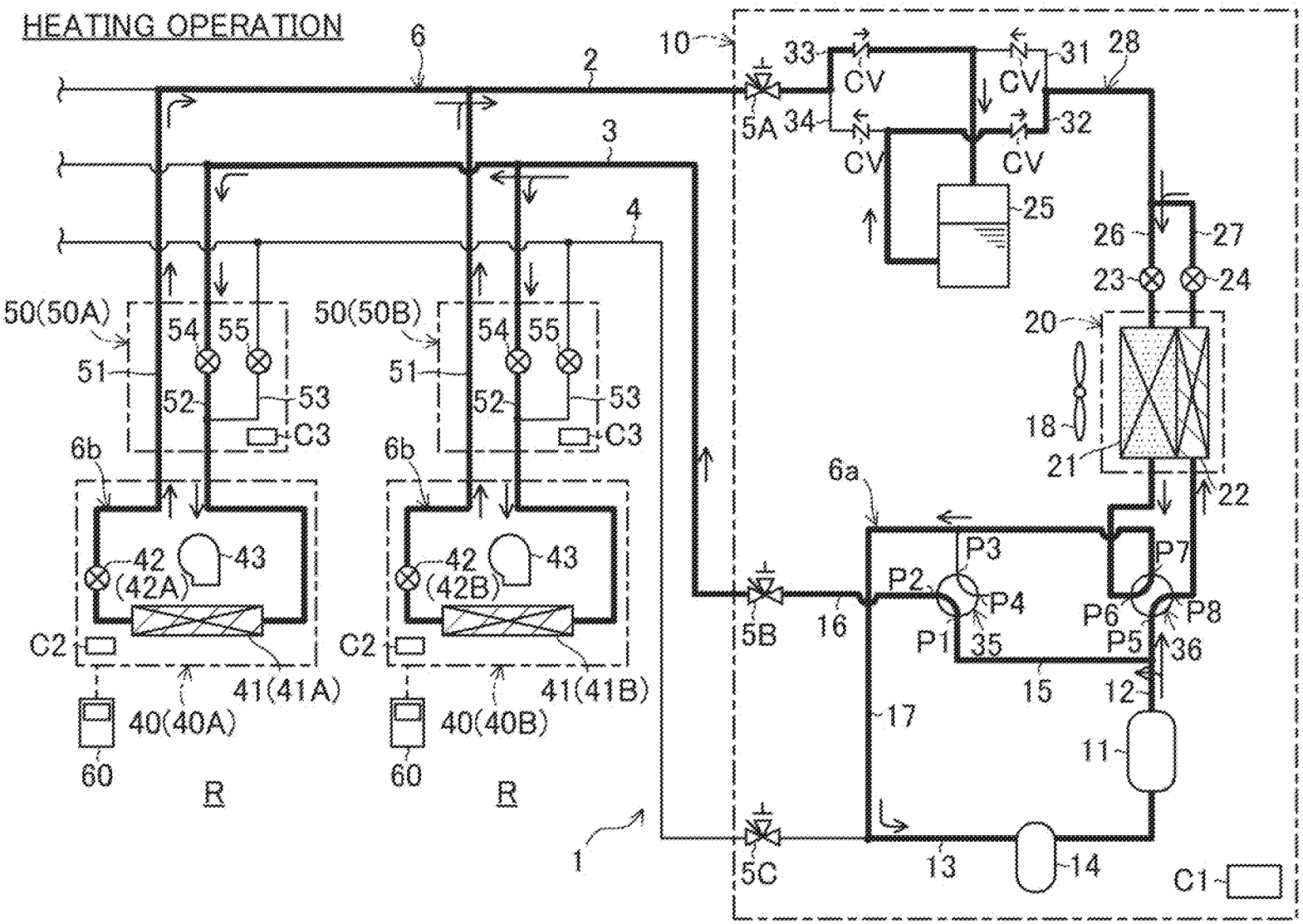
FIG. 6 is a piping system diagram of the air conditioner, and illustrates a flow of the refrigerant during a heating operation.

The air conditioner (1) during the heating operation illustrated in FIG. 6 performs a refrigeration cycle in which the second heat exchange section (22), the first indoor heat exchanger (41A), and the second indoor heat exchanger (41B) function as radiators, and the first heat exchange section (21) functions as an evaporator.

In the heating operation, the control unit (C) places the first four-way switching valve (35) in the first state, places the second four-way switching valve (36) in the fourth state, and adjusts the opening degree of the first outdoor expansion valve (23) so that the refrigerant is decompressed by the valve. The control unit (C) opens the second outdoor expansion valve (24), the first relay valves (54), the first indoor expansion valve (42A), and the second indoor expansion valve (42B). The control unit (C) closes the second relay valves (55). The control unit (C) operates the compressor (11), the outdoor fan (18), and the indoor fans (43).

A portion of the refrigerant compressed by the compressor (11) flows through the discharge branch pipe (15), and the remaining portion passes through the second four-way switching valve (36), and flows into the second flow path (27). The refrigerant in the discharge branch pipe (15) flows through the first four-way switching valve (35), the gas relay pipe (16), and the high and low pressure gas connection pipe (3), and is then diverted into the first and second flow path switching units (50A) and (50B).

The refrigerant that has flowed through the second relay pipe (52) of the first flow path switching unit (50A) flows through the first indoor heat exchanger (41A) of the first indoor unit (40A). In the first indoor heat exchanger (41A), the refrigerant dissipates heat to indoor air to condense. The air heated by the first indoor heat exchanger (41A) is supplied into the indoor space (R). The refrigerant that has dissipated heat in the first indoor heat exchanger (41A) passes through the first relay pipe (51) of the first flow path switching unit (50A), and then flows into the liquid connection pipe (2).

The refrigerant that has flowed through the second relay pipe (52) of the second flow path switching unit (50B) flows through the second indoor heat exchanger (41B) of the second indoor unit (40B). In the second indoor heat exchanger (41B), the refrigerant dissipates heat to indoor air to condense. The air heated by the second indoor heat exchanger (41B) is supplied into the indoor space (R). The refrigerant that has dissipated heat in the second indoor heat exchanger (41B) passes through the first relay pipe (51) of the second flow path switching unit (50B), and then flows into the liquid connection pipe (2).

The refrigerant in the liquid connection pipe (2) flows into the liquid line (28), and passes through the receiver (25). Meanwhile, the refrigerant that has flowed into the second flow path (27) as described above flows through the second heat exchange section (22). In the second heat exchange section (22), the refrigerant dissipates heat to outdoor air to condense.

The refrigerant that has passed through the receiver (25) and the refrigerant that has dissipated heat in the second heat exchange section (22) flow through the first flow path (26). The refrigerant in the first flow path (26) is decompressed by the first outdoor expansion valve (23), and then flows through the first heat exchange section (21). In the first heat exchange section (21), the refrigerant absorbs heat from outdoor air to evaporate. The refrigerant that has evaporated in the first heat exchange section (21) passes through the second four-way switching valve (36) and the suction branch pipe (17), and then flows through the suction pipe (13). The refrigerant in the suction pipe (13) passes through the accumulator (14), and is then sucked into the compressor (11) so as to be compressed again.

(4-3) Simultaneous Cooling and Heating Operation

Figure 7:
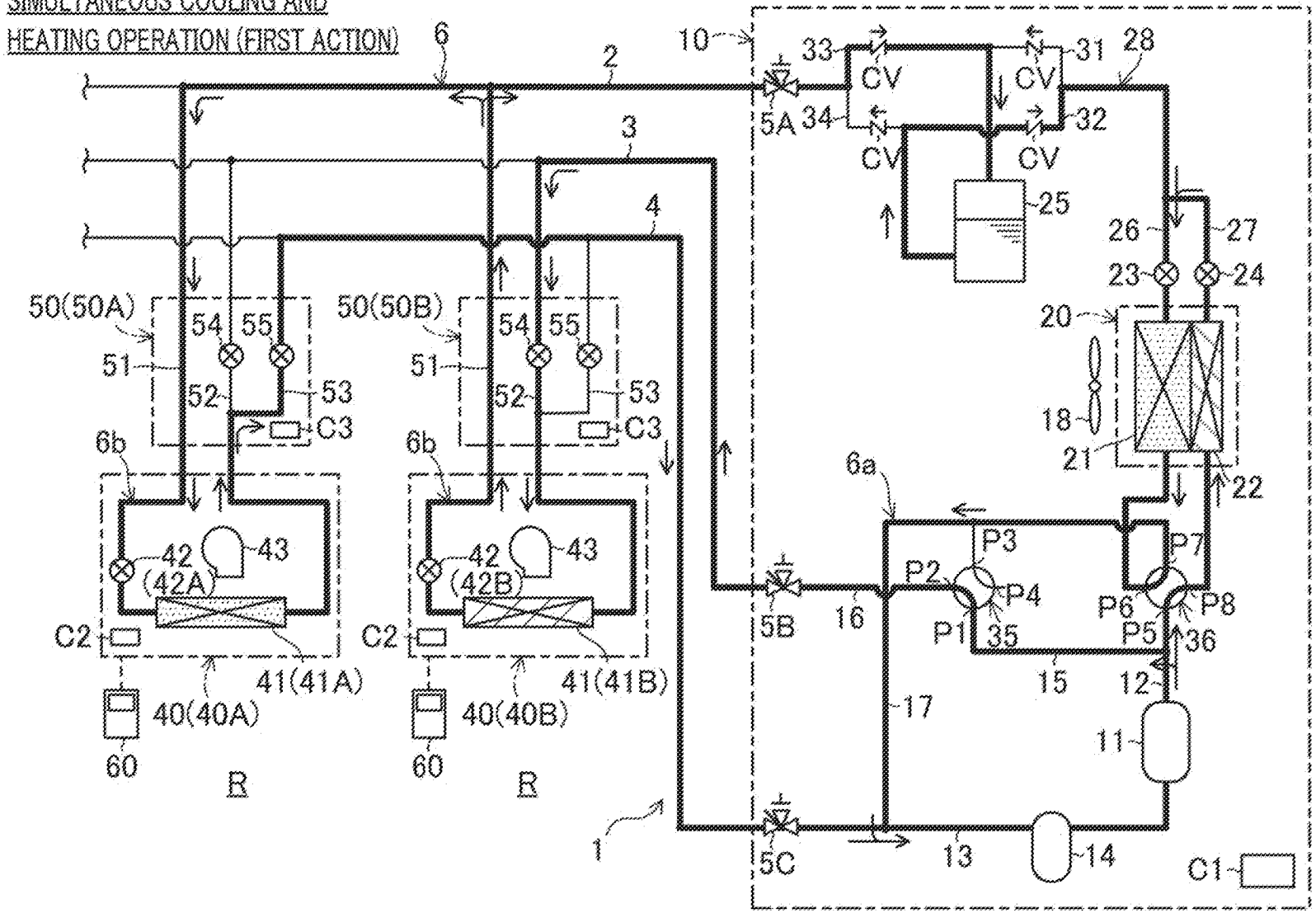
FIG. 7 is a piping system diagram of the air conditioner, and illustrates a flow of the refrigerant during a first action of a simultaneous cooling and heating operation.

An example of the simultaneous cooling and heating operation in which the first indoor unit (40A) performs a cooling action and the second indoor unit (40B) performs a heating action will be described below. The air conditioner (1) during the simultaneous cooling and heating operation illustrated in FIG. 7 performs a refrigeration cycle in which the second heat exchange section (22) and the second indoor heat exchanger (41B) function as radiators, and the first heat exchange section (21) and the first indoor heat exchanger (41A) function as evaporators.

In the simultaneous cooling and heating operation, the control unit (C) places the first four-way switching valve (35) in the first state, places the second four-way switching valve (36) in the fourth state, and adjusts the opening degrees of the first outdoor expansion valve (23) and the first indoor expansion valve (42A) so that the refrigerant is decompressed by these valves. The control unit (C) opens the second outdoor expansion valve (24), the first relay valve (55) of the first flow path switching unit (50A), the first relay valve (54) of the second flow path switching unit (50B), and the second indoor expansion valve (42B). The control unit (C) closes the first relay valve (54) of the first flow path switching unit (50A) and the second relay valve (55) of the second flow path switching unit (50B). The control unit (C) operates the compressor (11), the outdoor fan (18), and the indoor fans (43).

A portion of the refrigerant compressed by the compressor (11) flows through the discharge branch pipe (15), and the remaining portion passes through the second four-way switching valve (36), and flows into the second flow path (27). The refrigerant in the discharge branch pipe (15) flows through the first four-way switching valve (35), the gas relay pipe (16), and the high and low pressure gas connection pipe (3), and then flows through the second flow path switching unit (50B).

The refrigerant that has flowed through the second relay pipe (52) of the second flow path switching unit (50B) flows through the second indoor heat exchanger (41B) of the second indoor unit (40B). In the second indoor heat exchanger (41B), the refrigerant dissipates heat to indoor air to condense. The air heated by the second indoor heat exchanger (41B) is supplied into the indoor space (R). The refrigerant that has dissipated heat in the second indoor heat exchanger (41B) passes through the first relay pipe (51) of the second flow path switching unit (50B), and then flows into the liquid connection pipe (2).

Part of the refrigerant in the liquid connection pipe (2) flows into the first flow path switching unit (50A). The refrigerant that has flowed through the first relay pipe (51) of the first flow path switching unit (50A) is decompressed by the first indoor expansion valve (42A) of the first indoor unit (40A), and then flows through the first indoor heat exchanger (41A). In the first indoor heat exchanger (41A), the refrigerant absorbs heat from indoor air to evaporate. The air cooled by the first indoor heat exchanger (41A) is supplied into the indoor space (R). The refrigerant that has evaporated in the first indoor heat exchanger (41A) passes through the third relay pipe (53) of the first flow path switching unit (50A), and then flows into the low pressure gas connection pipe (4).

The remaining portion of the refrigerant in the liquid connection pipe (2) flows into the liquid line (28), and passes through the receiver (25). Meanwhile, the refrigerant that has flowed into the second flow path (27) as described above flows through the second heat exchange section (22). In the second heat exchange section (22), the refrigerant dissipates heat to outdoor air to condense. The refrigerant that has passed through the receiver (25) and the refrigerant that has dissipated heat in the second heat exchange section (22) flow through the first flow path (26). The refrigerant in the first flow path (26) is decompressed by the first outdoor expansion valve (23), and then flows through the first heat exchange section (21). In the first heat exchange section (21), the refrigerant absorbs heat from outdoor air to evaporate. The refrigerant that has evaporated in the first heat exchange section (21) passes through the second four-way switching valve (36) and the suction branch pipe (17).

The refrigerant in the low pressure gas connection pipe (4) and the refrigerant in the suction branch pipe (17) flow through the suction pipe (13). The refrigerant in the suction pipe (13) passes through the accumulator (14), and is then sucked into the compressor (11) so as to be compressed again.

(4-4) Defrosting Operation

In the heating operation and the simultaneous cooling and heating operation, satisfaction of a predetermined condition allows the control unit (C) to make the air conditioner (1) perform a defrosting operation. The predetermined condition is a condition indicating that the first heat exchange section (21) is frosted. Examples of the predetermined condition include the condition that the period during which the heating operation or the simultaneous cooling and heating operation is performed have exceeded a predetermined period, and the condition that a condition indicating that the evaporation capacity of the first heat exchange section (21) has decreased have been satisfied.

Figure 8:
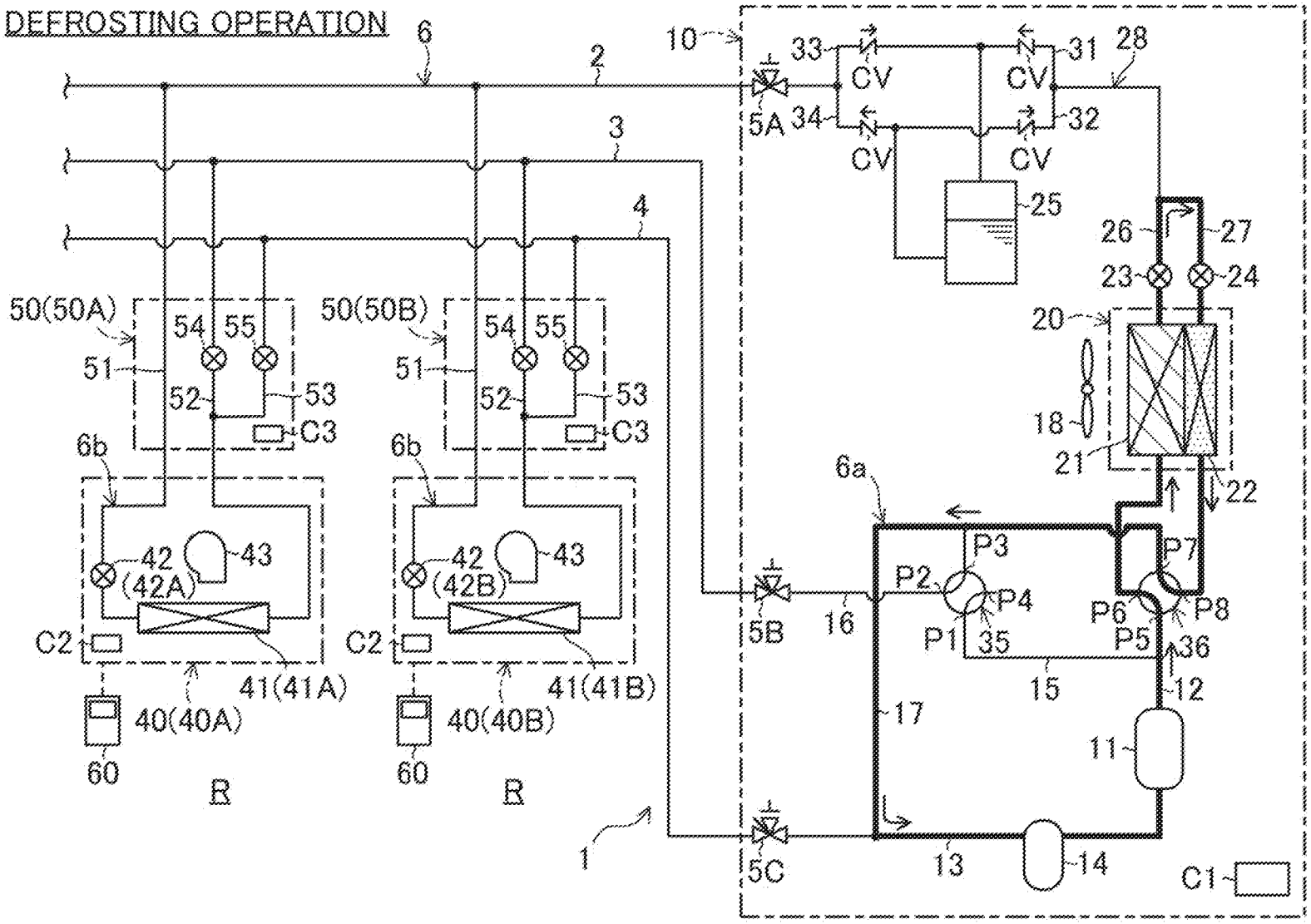
FIG. 8 is a piping system diagram of the air conditioner, and illustrates a flow of the refrigerant during a defrosting operation.

The air conditioner (1) during the defrosting operation illustrated in FIG. 8 performs a refrigeration cycle in which the second heat exchange section (22) functions as a radiator, and the first heat exchange section (21) functions as an evaporator. In the defrosting operation of this example, the control unit (C) deactivates all of the indoor units (40). Specifically, the control unit (C) places the first four-way switching valve (35) in the second state, places the second four-way switching valve (36) in the third state, and adjusts the opening degree of the second outdoor expansion valve (24) so that the refrigerant is decompressed by the valve. The control unit (C) opens the first outdoor expansion valve (23). The control unit (C) closes the first and second indoor expansion valves (42A) and (42B), the first relay valves (54), and the second relay valves (55). The control unit (C) operates the compressor (11) and the outdoor fan (18), and stops the indoor fans (43). In the defrosting operation, the control unit (C) may adjust the opening degree of the first outdoor expansion valve (23) so that the refrigerant is decompressed by the valve.

The refrigerant compressed by the compressor (11) passes through the second four-way switching valve (36), and flows into the first flow path (26). The refrigerant in the first flow path (26) flows through the first heat exchange section (21). In the first heat exchange section (21), the refrigerant dissipates heat to melt frost on the surface of the first heat exchange section (21). The refrigerant that has dissipated heat in the first heat exchange section (21) flows into the second flow path (27), is decompressed by the second outdoor expansion valve (24), and then flows through the second heat exchange section (22). In the second heat exchange section (22), the refrigerant absorbs heat from outdoor air to evaporate. Thus, the heat of the outdoor air can be used to defrost the first heat exchange section (21). The refrigerant that has evaporated in the second heat exchange section (22) flows through the second four-way switching valve (36), the suction branch pipe (17), and the suction pipe (13), and is sucked into the compressor (11) so as to be compressed again.

(5) Flow of Refrigerant Through First and Second Heat Exchange Sections

In the heating operation and the simultaneous cooling and heating operation described above, the first heat exchange section (21) functions as an evaporator. The outdoor air cooled by the first heat exchange section (21) functioning as an evaporator in winter or similar conditions causes condensation water to be generated from the air. If the condensation water falls to the lower end of the outdoor heat exchanger (20) or to a drain pan at the bottom of the casing and freezes, ice is generated from the lower end of the outdoor heat exchanger (20). The ice gradually growing upward would impair the performance of the outdoor heat exchanger (20). To address this problem, in the heating operation and the simultaneous cooling and heating operation of this embodiment, the second heat exchange section (22) below the first heat exchange section (21) functions as a radiator, thereby reducing such growth of ice.

Specifically, for example, in the heating operation and the simultaneous cooling and heating operation, a low-pressure gas refrigerant flows into, for example, the first upper pipe (75*a*) in the outdoor heat exchanger (20) illustrated in FIG. 4. The refrigerant is diverted from the first upper flow path (71*a*) into the plurality of first heat transfer tubes (77) of the first heat exchange section (21). The refrigerant flowing through the first heat transfer tubes (77) absorbs heat from outdoor air to evaporate. The refrigerant in the plurality of first heat transfer tubes (77) flows through the second upper flow path (72*a*), and flows out into the second upper pipe (76*a*). Condensation water in the air may be generated on the surfaces of the first heat transfer tubes (77). The condensation water flows down to the lower end of the second heat exchange section (22) along the fins (79).

A high-pressure gas refrigerant flows into, for example, the first lower pipe (75*b*). The refrigerant is diverted from the first lower flow path (71*b*) into the plurality of second heat transfer tubes (78) of the second heat exchange section (22). The refrigerant flowing through the second heat transfer tubes (78) dissipates heat to outdoor air. The refrigerant that has flowed through the plurality of second heat transfer tubes (78) flows through the second lower flow path (72*b*), and flows out into the second lower pipe (76*b*). The refrigerant in the second heat exchange section (22) dissipates heat, thereby reducing ice generating on a lower portion of the outdoor heat exchanger (20) or on the surface of the second heat exchange section (22). In addition, when ice is accumulated in the drain pan below the outdoor heat exchanger (20), this ice can be melted by heat of the second heat exchange section (22).

In this example, the direction of the flow of the refrigerant flowing through the first heat transfer tubes (77) of the first heat exchange section (21) is the same as the direction of the flow of the refrigerant flowing through the second heat transfer tubes (78) of the second heat exchange section (22). However, the direction of the flow of the refrigerant flowing through the first heat transfer tubes (77) of the first heat exchange section (21) may be opposite to the direction of the flow of the refrigerant flowing through the second heat transfer tubes (78) of the second heat exchange section (22).

(6) Control Example in Simultaneous Cooling and Heating Operation

Figure 9:
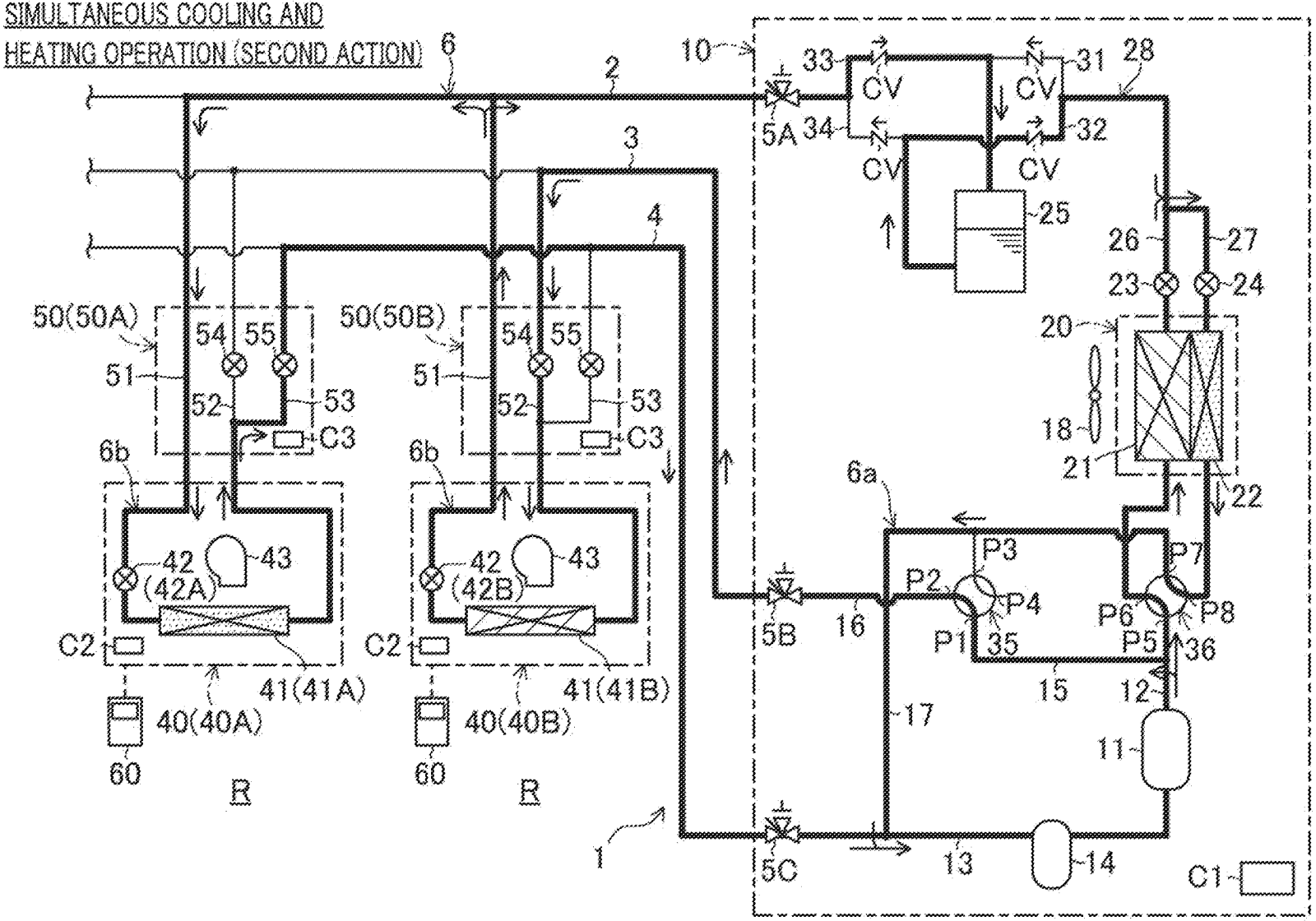
FIG. 9 is a piping system diagram of the air conditioner, and illustrates a flow of the refrigerant during a second action of the simultaneous cooling and heating operation.

In the simultaneous cooling and heating operation described above, the state of the second four-way switching valve (36) may be switched in accordance with the operating condition of the air conditioner (1). Specifically, in the simultaneous cooling and heating operation illustrated in FIG. 7 (hereinafter also referred to as the "first action of the simultaneous cooling and heating operation"), the amount of heat dissipated from the refrigerant in the refrigerant circuit (6) may be insufficient. As a result, the heat of the refrigerant may be in excess. In this case, the high pressure of the refrigerant circuit (6) may rise excessively. This may prevent an intended operation from continuing. To address this problem, if a first condition indicating that the heat of the refrigerant in the refrigerant circuit (6) is in excess is satisfied during the first action of the simultaneous cooling and heating operation, the control unit (C) switches the second four-way switching valve (36) from the fourth state to the third state. Thus, the air conditioner (1) performs a second action of the simultaneous cooling and heating operation illustrated in FIG. 9. Examples of the "first condition" as used herein include the condition that the pressure of the high-pressure refrigerant or the low-pressure refrigerant be higher than a predetermined value, the condition that the degree of dryness of the discharged refrigerant or the suction refrigerant be higher than a predetermined value, and the condition that the heating load on the utilization unit (40) that is performing the heating action be low.

The air conditioner (1) during the second action of the simultaneous cooling and heating operation performs a refrigeration cycle in which the first heat exchange section (21) and the second indoor heat exchanger (41B) function as radiators, and the second heat exchange section (22) and the first indoor heat exchanger (41A) function as evaporators. The control unit (C) controls the second outdoor expansion valve (24) so that the refrigerant is decompressed by the second outdoor expansion valve (24). The control unit (C) opens the first outdoor expansion valve (23), and adjusts the opening degree of the valve as appropriate. The other processes of control performed in the second action are the same as those of the control performed in the first action.

In the second action of the simultaneous cooling and heating operation, part of the refrigerant compressed by the compressor (11) dissipates heat in the first heat exchange section (21). This refrigerant flows through the second flow path (27) together with the refrigerant flowing out of the liquid line (28), and evaporates in the second heat exchange section (22). As described above, the first heat exchange section (21) functioning as a radiator has a greater size than the second heat exchange section (22) does. Thus, in the second action, the amount of heat dissipated from the entire refrigerant circuit (6) can be increased, thereby keeping the heat of the refrigerant from being in excess.

On the other hand, if a second condition indicating that the heat of the refrigerant is insufficient is satisfied in the second action of the simultaneous cooling and heating operation, the control unit (C) switches the second four-way switching valve (36) from the fourth state to the third state. Thus, the air conditioner (1) performs the first action of the cooling and heating operation. As a result, the first heat exchange section (21) functions as an evaporator. This can eliminate the heat shortage in the refrigerant. Examples of the "second condition" as used herein include the condition that the pressure of the high-pressure refrigerant or the low-pressure refrigerant be lower than the predetermined value, the condition that the degree of dryness of the discharged refrigerant or the suction refrigerant be lower than the predetermined value, and the condition that the heating load on the utilization unit (40) that is performing the heating action be high.

(7) Features 7-1

The outdoor unit (10) of the embodiment includes the liquid line (28), the first four-way switching valve (35), and the second four-way switching valve (36). The liquid line (28) is connected to the liquid end of the first heat exchange section (21) and the liquid end of the second heat exchange section (22). The first four-way switching valve (35) switches between the first state where the first four-way switching valve (35) brings the high and low pressure gas connection pipe (3) and the discharge side of the compressor (11) into communication with each other and the second state where the first four-way switching valve (35) brings the high and low pressure gas connection pipe (3) and the suction side of the compressor (11) into communication with each other. The second four-way switching valve (36) switches between the third state where while the second four-way switching valve (36) brings the discharge side of the compressor (11) and the gas end of the first heat exchange section (21) into communication with each other, the second four-way switching valve (36) brings the suction side of the compressor (11) and the gas end of the second heat exchange section (22) into communication with each other and the fourth state where while the second four-way switching valve (36) brings the discharge side of the compressor (11) and the gas end of the second heat exchange section (22) into communication with each other, the second four-way switching valve (36) brings the suction side of the compressor (11) and the gas end of the first heat exchange section (21) into communication with each other.

An outdoor unit (10) of a known example has three four-way switching valves, whereas the outdoor unit (10) of this embodiment switches the states of the two four-way switching valves (35, 36) so that the air conditioner (1) can perform the cooling operation, the heating operation, and the simultaneous cooling and heating operation. This can simplify the configuration of the outdoor unit (10) and reduce cost.

In addition, with this configuration, in any one of the operations, one of the first or second heat exchange section (21) or (22) functions as a radiator, and the other functions as an evaporator. Suppose here that if the air-conditioning load on the air conditioner (1) varies greatly, both of the first and second heat exchange sections (21) and (22) function as radiators, or both of them function as evaporators. In that case, variations in the air-conditioning load may cause the heat of the refrigerant to be significantly in excess or to be significantly insufficient. In this case, it may take time before such an operating state is eliminated. This may prevent the air-conditioning load from being adequately processed. To address this problem, in this embodiment, one of the first or second heat exchange sections (21) or (22) functions as a radiator, and the other functions as an evaporator. This can keep variations in the air-conditioning load on the air conditioner (1) from causing the heat of the refrigerant to be significantly in excess or to be significantly insufficient. Thus, the air conditioner (1) can operate stably.

7-2

The first heat exchange section (21) has a greater size than the second heat exchange section (22) does. Thus, in the cooling operation, the amount of heat dissipated from the refrigerant in the first heat exchange section (21) can be increased. This can increase the cooling capacity of the indoor units (40). In the heating operation, the amount of heat absorbed by the refrigerant (the amount of evaporation of the refrigerant) in the first heat exchange section (21) can be increased. This can increase the heating capacity of the indoor units (40). In the first action of the simultaneous cooling and heating operation, the amount of heat absorbed by the refrigerant (the amount of evaporation of the refrigerant) in the first heat exchange section (21) can be increased. This can increase the heating capacity of the indoor unit (40) that is performing the heating action.

7-3

The ratio S2/S1 of the size S2 of the second heat exchange section (22) to the size S1 of the first heat exchange section (21) is higher than or equal to 1/10 and equal to or lower than 1/5.

If the ratio S2/S1 is lower than 1/10, the second heat exchange section (22) has an excessively small size. As a result, the air-conditioning load varying as described above may cause the heat of the refrigerant to be significantly in excess or to be significantly insufficient. In contrast, if the ratio S2/S1 is higher than or equal to 1/10, a sufficient amount of heat can be absorbed or dissipated in the second heat exchange section (22). As a result, the air conditioner (1) can operate stably. In addition, a ratio S2/S1 higher than or equal to 1/10 increases the amount of heat dissipated in the second heat exchange section (22) in the heating operation and the simultaneous cooling and heating operation. As a result, the growth of ice on the lower portion of the outdoor heat exchanger (20) can be effectively reduced.

If the ratio S2/S1 is higher than 1/5, the first heat exchange section (21) has an excessively small size. As a result, the amount of heat dissipated from the refrigerant in the cooling operation may be insufficient, or the amount of heat absorbed by the refrigerant in the heating operation and the simultaneous cooling and heating operation may be insufficient. In contrast, if the ratio S2/S1 is equal to or lower than 1/5, the first heat exchange section (21) can have a sufficient size. As a result, the amount of heat dissipated from the refrigerant can be kept from being insufficient during the cooling operation. Thus, a sufficient cooling capacity can be provided. The amount of heat absorbed by the refrigerant can be kept from being insufficient during the heating operation and the simultaneous cooling and heating operation. Thus, a sufficient heating capacity can be provided.

7-4

The second heat exchange section (22) is arranged below the first heat exchange section (21). Thus, in the heating operation and the simultaneous cooling and heating operation, the second heat exchange section (22) functioning as a radiator can reduce the growth of ice. In addition, the second heat exchange section (22) can melt ice accumulated in the drain pan.

7-5

The outdoor fan (18) is arranged above the first heat exchange section (21), and transfers air upward. Thus, in the outdoor heat exchanger (20), the flow volume of the air flowing through the first heat exchange section (21) is higher than that of the air flowing through the second heat exchange section (22). This is because the outdoor fan (18) is closer to the first heat exchange section (21) than to the second heat exchange section (22). This can increase the amount of heat dissipated or absorbed in the first heat exchange section (21) serving as a main heat exchange section. This can increase the cooling capacity and the heating capacity.

7-6

The outdoor unit (10) performs the defrosting operation in which the second four-way switching valve (36) is placed in the third state, the first heat exchange section (21) functions as a radiator, and the second heat exchange section (22) functions as an evaporator. In this defrosting operation, the heat absorbed in the second heat exchange section (22) can be used to defrost the first heat exchange section (21). In addition, in the defrosting operation, the first heat exchange section (21) can be defrosted while the refrigerant is circulated only through the outdoor unit (10). This can shorten the flow path of the refrigerant, and can reduce the pressure loss. In addition, since the refrigerant does not evaporate in the indoor units (40), the indoor air can be kept from being cooled.

(8) Variations

The foregoing embodiment may be modified into the following variations. Differences from the embodiment will be described below.

(8-1) First Variation

Figure 10:
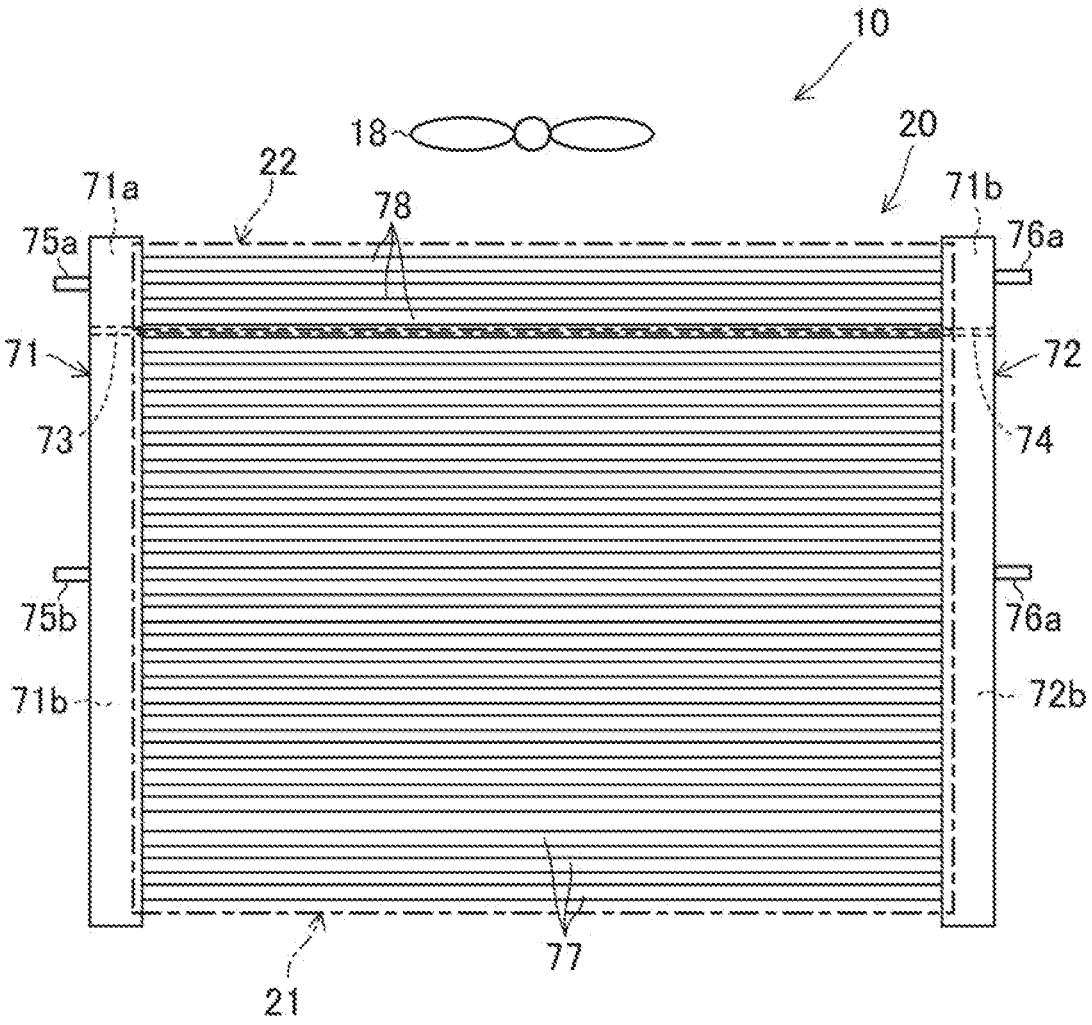
FIG. 10 schematically illustrates a configuration for an outdoor heat exchanger according to a first variation.

An air conditioner (1) of a first variation is different from that of the embodiment in the configuration of the outdoor heat exchanger (20). As illustrated in FIG. 10, the outdoor heat exchanger (20) of the first variation includes a second heat exchange section (22) arranged above a first heat exchange section (21). A first partition plate (73) is provided in an upper portion of a first header collecting pipe (71). A second partition plate (74) is provided in an upper portion of a second header collecting pipe (72). One end of each of a plurality of second heat transfer tubes (78) of the second heat exchange section (22) communicates with a first upper pipe (75*a*) through a first upper flow path (71*a*). The other end of the second heat transfer tube (78) of the second heat exchange section (22) communicates with a second upper pipe (76*a*) through a second upper flow path (72*a*). One end of each of a plurality of first heat transfer tubes (77) of the first heat exchange section (21) communicates with a first lower pipe (75*b*) through a first lower flow path (71*b*). The other end of the first heat transfer tube (77) of the first heat exchange section (21) communicates with a second lower pipe (76*b*) through a second lower flow path (72*b*).

An outdoor fan (18) of the first variation is arranged above the second heat exchange section (22), and transfers air upward. Thus, in the outdoor heat exchanger (20), the flow volume of the air flowing through the second heat exchange section (22) is higher than that of the air flowing through the first heat exchange section (21). This is because the outdoor fan (18) is closer to the second heat exchange section (22) than to the first heat exchange section (21). The second heat exchange section (22) has a smaller size than the first heat exchange section (21) does. However, increasing the flow volume of the air through the second heat exchange section (22) allows a sufficient amount of heat to be dissipated from, and absorbed by, the refrigerant in the second heat exchange section (22).

(8-2) Second Variation

Figure 11:
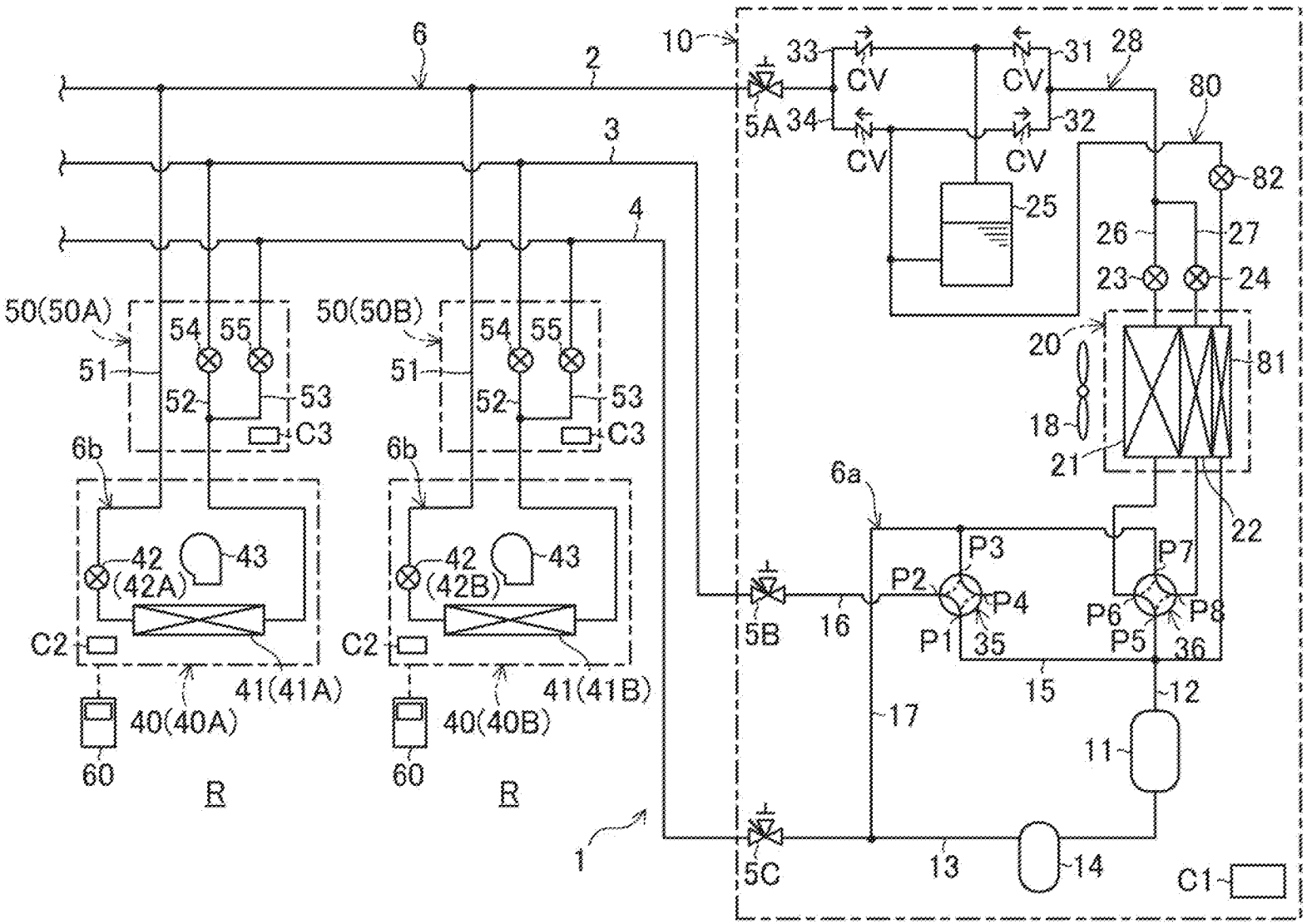
FIG. 11 is a piping system diagram of an air conditioner according to a second variation.

An air conditioner (1) of a second variation includes a bypass circuit (80) additionally included in the outdoor unit (10) of the embodiment. As illustrated in FIG. 11, one end of the bypass circuit (80) is connected to the discharge side of the compressor (11) (strictly speaking, the discharge pipe (12)). The other end of the bypass circuit (80) is connected to a portion of the liquid line (28) downstream of the receiver (25). The diameter of a pipe forming the bypass circuit (80) is equal to or smaller than that of a pipe forming the first flow path (26) and that of a pipe forming the first flow path (26). The bypass circuit (80) is provided with a drain pan heater (81) and a bypass valve (82) in this order from the gas end toward the liquid end thereof.

The drain pan heater (81) is arranged below the outdoor heat exchanger (20). In this variation, the drain pan heater (81) is arranged below the second heat exchange section (22). The drain pan heater (81) is provided along the bottom of the drain pan. The bypass valve (82) is an example of an on-off valve that opens and closes the bypass circuit (80). The bypass valve (82) is configured as an electronic expansion valve, but may be an electromagnetic on-off valve.

In the second variation, the bypass valve (82) is opened as appropriate in the heating operation and the simultaneous cooling and heating operation. Thus, part of the refrigerant discharged from the compressor (11) flows through the drain pan heater (81). In the drain pan heater (81), the refrigerant dissipates heat to melt ice accumulated in the drain pan. The refrigerant that has dissipated heat in the drain pan heater (81) passes through the bypass valve (82), and is sent to the portion of the liquid line (28) downstream of the receiver (25). The pressure of a downstream portion of the liquid line (28) is lower than that of an upstream portion of the liquid line (28). This can provide a sufficient pressure difference required to allow the refrigerant to flow through the bypass circuit (80).

(9) Other Embodiments

In the embodiment, the first and second heat exchange sections (21) and (22) are incorporated into the single outdoor heat exchanger (20). However, the first and second heat exchange sections (21) and (22) may be separate heat exchangers. In this case, the first heat exchange section (21) constitutes a first heat source heat exchanger (first outdoor heat exchanger), and the second heat exchange section (22) constitutes a second heat source heat exchanger (second outdoor heat exchanger).

The flow path switching units (50) of the embodiment may function as shut-off devices that shut off the associated indoor circuits (6*b*) from the three connection pipes (2, 3, 4). In this case, the first relay pipe (51) of each flow path switching unit (50) may be provided with a valve. If the refrigerant has leaked from an indoor unit (40) to the outside, closing the valves of the associated flow path switching unit (50) allows the associated indoor circuit (6*b*) to be shut off from the three connection pipes (2, 3, 4). In other words, the valves of the flow path switching unit (50) function as shut-off valves.

The first switching valve (35) may be a three-way valve having a first port (P1), a second port (P2), and a third port (P3). In this case, the first switching valve (35) switches between a first state where the first switching valve (35) brings the first port (P1) and the second port (P2) into communication with each other and a second state where the first switching valve (35) brings the first port (P1) and the third port (P3) into communication with each other.

The indoor units (40) do not have to be of a ceiling-mounted type, and may be of a wall-mounted type or a floor-standing type.

While the embodiments and variations thereof have been described above, it will be understood that various changes in form and details may be made without departing from the spirit and scope of the claims. The embodiments, the variations thereof, and the other embodiments may be combined and replaced with each other without deteriorating intended functions of the present disclosure.

The expressions of "first," "second," "third," . . . described above are used to distinguish the words to which these expressions are given, and the number and order of the words are not limited.

INDUSTRIAL APPLICABILITY

As can be seen from the foregoing description, the present disclosure is useful for a heat source unit and an air conditioner.

EXPLANATION OF REFERENCES

1 Air Conditioner
2 Liquid Connection Pipe
3 High and Low Pressure Gas Connection Pipe
4 Low Pressure Gas Connection Pipe
5 Heat Source Unit
11 Compressor
18 Outdoor Fan (Fan)
21 First Heat Exchange Section
22 Second Heat Exchange Section
28 Liquid Line
35 First Four-Way Switching Valve (First Switching Valve)
36 Second Four-Way Switching Valve (Second Switching Valve)
40A First Indoor Unit (First Utilization Unit)
40B Second Indoor Unit (Second Utilization Unit)
50A First Flow Path Switching Unit
50B Second Flow Path Switching Unit

The invention claimed is:

1. A heat source unit connected to a first flow path switching unit and a second flow path switching unit through a liquid connection pipe, a high and low pressure gas connection pipe, and a low pressure gas connection pipe provided in an air conditioner configured to perform a cooling operation, a heating operation, and a simultaneous cooling and heating operation, the air conditioner comprising, the first flow path switching unit connected to a first utilization unit, the second flow path switching unit connected to a second utilization unit, the heat source unit comprising:

a compressor configured to compress a refrigerant;

a first heat exchange section configured to exchange heat between the refrigerant and air;

a second heat exchange section configured to exchange heat between the refrigerant and the air;

a liquid line connected to a liquid end of the first heat exchange section and a liquid end of the second heat exchange section;

a first switching valve configured to switch between a first state where the first switching valve brings the high and low pressure gas connection pipe and a discharge side of the compressor into communication with each other and a second state where the first switching valve brings the high and low pressure gas connection pipe and a suction side of the compressor into communication with each other; and a second switching valve configured to switch between a third state where while the second switching valve brings the discharge side of the compressor and a gas end of the first heat exchange section into communication with each other, the second switching valve brings the suction side of the compressor and a gas end of the second heat exchange section into communication with each other and a fourth state where while the second switching valve brings the discharge side of the compressor and the gas end of the second heat exchange section into communication with each other, the second switching valve brings the suction side of the compressor and the gas end of the first heat exchange section into communication with each other.

2. The heat source unit of claim 1, wherein the first heat exchange section has a greater size than the second heat exchange section does.

3. The heat source unit of claim 2, wherein a ratio S2/S1 of a size S2 of the second heat exchange section to a size S1 of the first heat exchange section is higher than or equal to 1/10 and equal to or lower than 1/5.

4. The heat source unit of claim 2, wherein the second heat exchange section is arranged below the first heat exchange section.

5. The heat source unit of claim 4, further comprising:

a fan arranged above the second heat exchange section and configured to transfer air that has passed through the first and second heat exchange sections and upward.

6. The heat source unit of claim 2, wherein the second heat exchange section is arranged below the first heat exchange section, and the heat source unit further includes a fan arranged above the first heat exchange section and configured to transfer air that has passed through the first and second heat exchange sections and upward.

7. The heat source unit of claim 1, wherein a defrosting operation is performed in which the second switching valve is placed in the third state, the first heat exchange section functions as a radiator, and the second heat exchange section functions as an evaporator.

8. The heat source unit of claim 3, wherein the second heat exchange section is arranged below the first heat exchange section.

9. The heat source unit of claim 3, wherein the second heat exchange section is arranged below the first heat exchange section, and the heat source unit further includes a fan arranged above the first heat exchange section and configured to transfer air that has passed through the first and second heat exchange sections and upward.

10. The heat source unit of claim 2, wherein a defrosting operation is performed in which the second switching valve is placed in the third state, the first heat exchange section functions as a radiator, and the second heat exchange section functions as an evaporator.

11. The heat source unit of claim 3, wherein a defrosting operation is performed in which the second switching valve is placed in the third state, the first heat exchange section functions as a radiator, and the second heat exchange section functions as an evaporator.

12. The heat source unit of claim 4, wherein a defrosting operation is performed in which the second switching valve is placed in the third state, the first heat exchange section functions as a radiator, and the second heat exchange section functions as an evaporator.

13. The heat source unit of claim 5, wherein a defrosting operation is performed in which the second switching valve is placed in the third state, the first heat exchange section functions as a radiator, and the second heat exchange section functions as an evaporator.

14. The heat source unit of claim 6, wherein a defrosting operation is performed in which the second switching valve is placed in the third state, the first heat exchange section functions as a radiator, and the second heat exchange section functions as an evaporator.

15. An air conditioner configured to perform a cooling operation, a heating operation, and a simultaneous cooling and heating operation, wherein the air conditioner comprises a heat source unit, a first flow path switching unit and a second flow path switching unit connected to the heat source unit through a liquid connection pipe, a high and low pressure gas connection pipe, and a low pressure gas connection pipe, the first flow path switching unit and the second flow path switching unit being connected to a first utilization unit and a second utilization unit, respectively, wherein the heat source unit comprises:

a compressor configured to compress a refrigerant;

a first heat exchange section configured to exchange heat between the refrigerant and air;

a second heat exchange section configured to exchange heat between the refrigerant and the air;

a liquid line connected to a liquid end of the first heat exchange section and a liquid end of the second heat exchange section;

a first switching valve configured to switch between a first state where the first switching valve brings the high and low pressure gas connection pipe and a discharge side of the compressor into communication with each other and a second state where the first switching valve brings the high and low pressure gas connection pipe and a suction side of the compressor into communication with each other; and a second switching valve configured to switch between a third state where while the second switching valve brings the discharge side of the compressor and a gas end of the first heat exchange section into communication with each other, the second switching valve brings the suction side of the compressor and a gas end of the second heat exchange section into communication with each other and a fourth state where while the second switching valve brings the discharge side of the compressor and the gas end of the second heat exchange section into communication with each other, the second switching valve brings the suction side of the compressor and the gas end of the first heat exchange section into communication with each other.

* * * * *